US006530504B2

(12) United States Patent
Socier

(10) Patent No.: US 6,530,504 B2
(45) Date of Patent: Mar. 11, 2003

(54) MULTIPLE ORIFICE VALVE

(75) Inventor: Timothy R. Socier, Essexville, MI (US)

(73) Assignee: Seaquist Closures Foreign, Inc., Crystal Lake, IL (US)

( * ) Notice: Subject to any disclaimer, the term of this patent is extended or adjusted under 35 U.S.C. 154(b) by 0 days.

(21) Appl. No.: 09/798,731

(22) Filed: Mar. 2, 2001

(65) Prior Publication Data

US 2002/0121530 A1 Sep. 5, 2002

(51) Int. Cl.[7] ..... B65D 25/40

(52) U.S. Cl. ..... 222/494; 222/212; 222/490; 222/493

(58) Field of Search ..... 222/185.1, 212, 222/490, 493, 494, 496

(56) References Cited

U.S. PATENT DOCUMENTS

| | | | |
|---|---|---|---|
| 1,206,661 | A | 11/1916 | Booth |
| 1,825,553 | A | 9/1931 | Smith |
| 1,989,714 | A | 2/1935 | Statham |
| 2,175,052 | A | 10/1939 | Bull et al. |
| 2,347,988 | A | 5/1944 | Burke |
| 2,591,354 | A | 4/1952 | Harris |
| 2,758,755 | A | 8/1956 | Schafler |
| 3,063,601 | A | 11/1962 | Hertz |
| 3,342,379 | A | 9/1967 | Foley |
| 3,490,488 | A | 1/1970 | Grist |
| 4,166,553 | A | 9/1979 | Fraterrigo |
| 4,408,702 | A | 10/1983 | Horvath |

(List continued on next page.)

FOREIGN PATENT DOCUMENTS

| | | |
|---|---|---|
| AT | 341931 | 8/1973 |
| AU | 2671988 | 9/1989 |
| CH | 1046518 | 10/1966 |
| CH | 477332 | 8/1969 |
| DE | 1250225 | 9/1967 |
| DE | 2128875 | 12/1972 |
| DE | 2354093 | 5/1975 |
| DE | 2341936 | 6/1975 |
| DE | 2609310 | 9/1976 |
| EP | 0226290 A2 | 6/1987 |
| EP | 0412390 A1 | 2/1991 |
| EP | 0442379 A2 | 8/1991 |

(List continued on next page.)

*Primary Examiner*—Henry C. Yuen
*Assistant Examiner*—Frederick C Nicolas
(74) *Attorney, Agent, or Firm*—Wood, Phillips, Katz, Clark & Mortimer

(57) ABSTRACT

A dispensing valve is provided for being sealingly disposed with respect to, and dispensing a product from, a discharge opening of a container. The preferred form of the valve includes a generally annular marginal portion adapted to be sealingly engaged when the valve is sealingly disposed with respect to the container discharge opening. The valve also includes a central head portion extending from the marginal portion. The head portion has an exterior side with a generally concave shape when viewed from outside the container and has an interior side with (1) a planar central area, and (2) a generally curved, radially outer portion which tapers toward the exterior side such that the periphery of the head portion is preferably thinner than the center of the head portion. The head portion includes at least one normally closed orifice that is defined by at least one slit that extends transversely through the head portion from the exterior side to the interior side to define flaps. The orifice opens by outward displacement of the flaps when the pressure in the interior of the container exceeds the pressure on the exterior of the valve by a predetermined amount.

22 Claims, 14 Drawing Sheets

U.S. PATENT DOCUMENTS

| | | | | | |
|---|---|---|---|---|---|
| 4,434,810 | A | | 3/1984 | Atkinson | |
| 4,470,523 | A | | 9/1984 | Spector | |
| 4,616,768 | A | * | 10/1986 | Flier | 137/494 |
| 4,728,006 | A | | 3/1988 | Drobish et al. | |
| 4,749,108 | A | | 6/1988 | Dornbusch et al. | |
| 4,794,750 | A | | 1/1989 | Schmidt et al. | |
| 4,987,740 | A | | 1/1991 | Coleman | |
| 4,991,745 | A | | 2/1991 | Brown | |
| 5,033,655 | A | | 7/1991 | Brown | |
| 5,071,017 | A | | 12/1991 | Stull | |
| 5,115,950 | A | | 5/1992 | Rohr | |
| 5,213,236 | A | * | 5/1993 | Brown et al. | 222/185.1 |
| 5,307,955 | A | | 5/1994 | Viegas | |
| 5,339,995 | A | | 8/1994 | Brown et al. | |
| 5,377,877 | A | | 1/1995 | Brown et al. | |
| 5,409,144 | A | | 4/1995 | Brown | |
| 5,439,143 | A | * | 8/1995 | Brown et al. | 222/185.1 |
| 5,472,123 | A | | 12/1995 | Jangaard | |
| 5,839,614 | A | * | 11/1998 | Brown | 222/185.1 |
| 5,975,354 | A | * | 11/1999 | Goncalves | 222/39 |
| 6,065,642 | A | * | 5/2000 | Brown | 222/494 |
| 6,089,411 | A | * | 7/2000 | Baudin et al. | 222/212 |
| 6,293,437 | B1 | * | 9/2001 | Socier et al. | 222/212 |

FOREIGN PATENT DOCUMENTS

| | | |
|---|---|---|
| FR | 996998 | 12/1951 |
| FR | 1038158 | 7/1955 |
| FR | 1135210 | 4/1957 |
| FR | 1183805 | 7/1959 |
| FR | 2467147 | 4/1981 |
| GB | 616957 | 6/1947 |
| GB | 625610 | 5/1948 |
| GB | 697201 | 9/1953 |
| GB | 1046518 | 10/1966 |
| GB | 2098958 | 12/1982 |
| GB | 0278125 | 8/1988 |
| GB | 0395380 | 10/1990 |
| GB | 2279130 | 12/1994 |
| JP | 5873738 | 5/1983 |
| JP | 2-11058 | 1/1990 |
| JP | 2-73151 | 3/1990 |
| JP | 2-83257 | 3/1990 |
| JP | 7-4216 | 1/1995 |
| SU | 145824 | 6/1962 |

* cited by examiner

FIG. 3 (PRIOR ART)
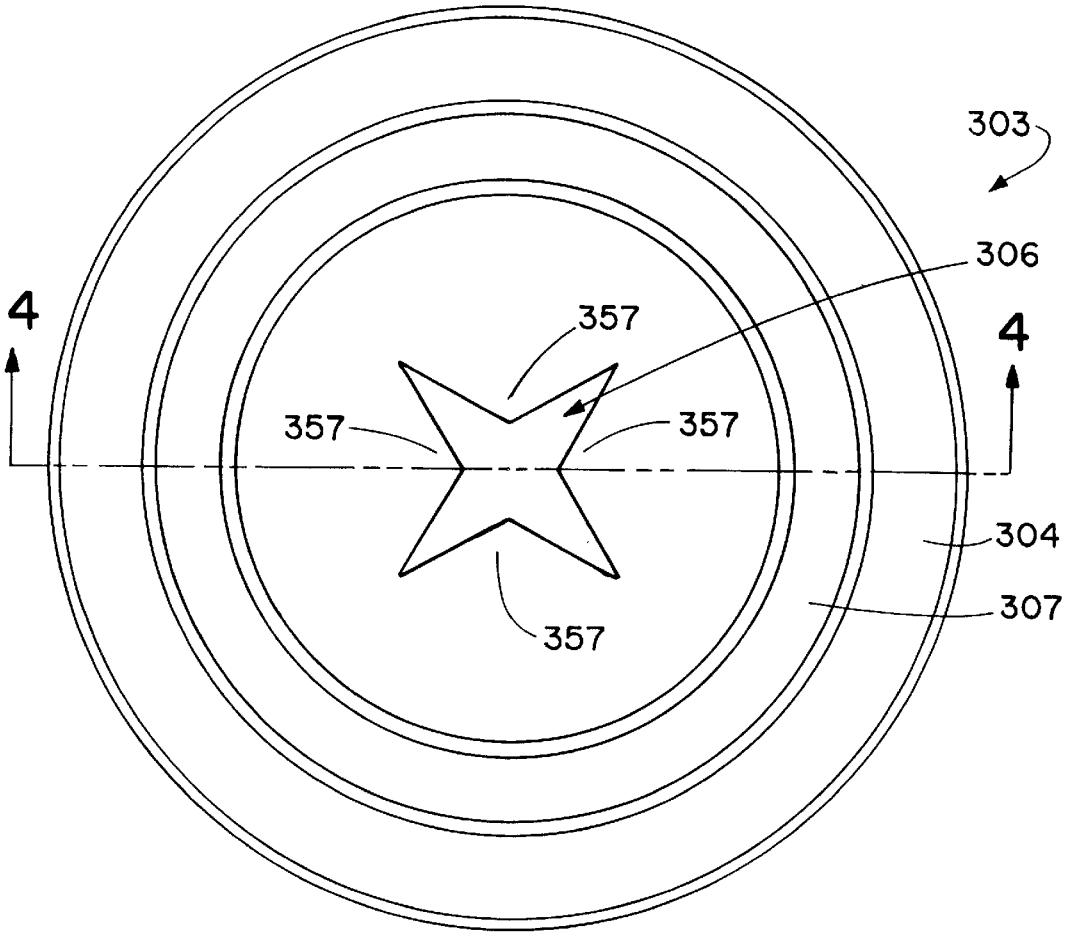
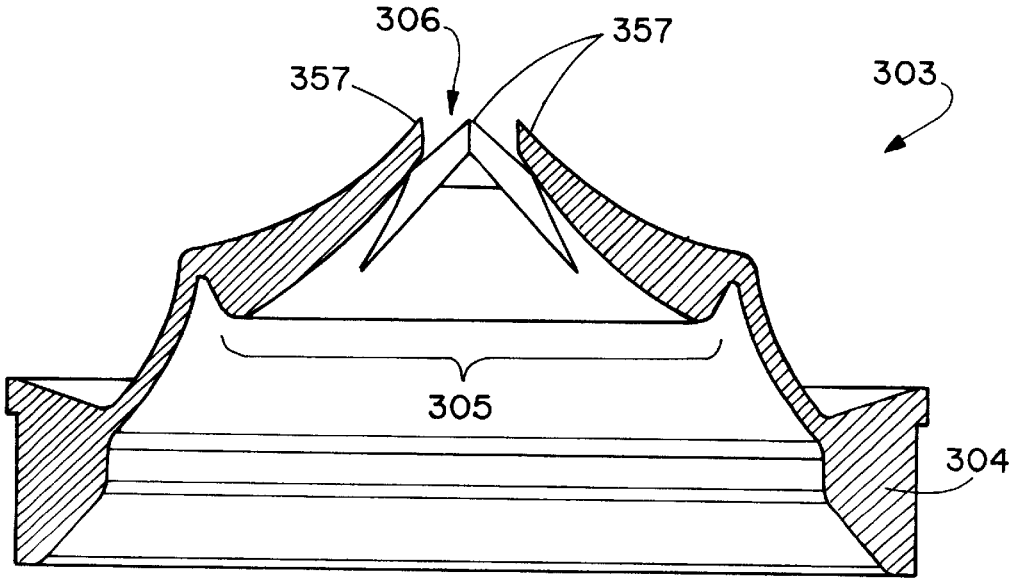
FIG. 4 (PRIOR ART)

MULTIPLE ORIFICE VALVE

STATEMENT REGARDING FEDERALLY SPONSORED RESEARCH OR DEVELOPMENT

Not applicable.

CROSS REFERENCE TO RELATED APPLICATION

Not applicable.

REFERENCE TO A MICROFICHE APPENDIX

Not applicable.

TECHNICAL FIELD

The present invention relates to a valve for dispensing a product from a container. The valve is especially suitable for use in a dispensing closure for a flexible container which is squeezable.

BACKGROUND OF THE INVENTION AND TECHNICAL PROBLEMS POSED BY THE PRIOR ART

There are a wide variety of packages which include (1) a container, (2) a dispensing system extending as a unitary part of, or attachment to, the container, and (3) a product contained within the container. One type of such a package employs a dispensing valve for discharging a single stream of product (which may be a liquid, cream, or particulate product). See, for example, the package shown with the valve identified by reference number 3*d* n FIGS. 26–29 of U.S. Pat. No. 5,377,877.

The disclosures of U.S. Pat. No. 5,377,877 are incorporated herein by reference hereto. The package disclosed in the patent includes a flexible, resilient, self-sealing, slit-type valve at one end of a generally flexible bottle or container. The preferred embodiment of the valve is normally closed and can withstand the weight of the product when the container is completely inverted, so that the product will not leak out unless the container is squeezed. When the container is squeezed and the interior is subjected to a sufficient increased pressure, and/or when the exterior of the valve is subjected to suction, the valve opens. In the preferred embodiments described in U.S. Pat. No. 5,377,877, the valve stays open until the pressure differential across the valve drops below a predetermined value, then the valve then snaps closed. The valve can also open inwardly to vent air into the container when the pressure within the container is less than the ambient external pressure, and this accommodates the return of the resilient container wall from an inwardly squeezed condition to the normal, unstressed condition.

The accompanying drawings that form part of this specification include FIGS. 1–4 which are simplified illustrations of the above-identified conventional valve. In FIGS. 1–4 that form part of this specification, the valve is indicated generally by the reference number 303. As shown in FIGS. 1 and 2, the valve 303 includes a marginal portion or flange 304, and a valve head or head portion 305 connected to the flange 304 with a flexible connector sleeve 307. The valve 303 has a single orifice 306 (FIGS. 3 and 4) which is normally closed and which is defined by four slits 350 which radiate laterally from an origin defined by a longitudinal axis 349 through the valve 303 as shown in FIGS. 1 and 2.

As shown in FIG. 2, the valve has an exterior side or surface 338 and an interior side or surface 339. The valve

303 is installed on a container (not shown) so that the exterior side 338 faces outwardly and is exposed to the external ambient atmosphere. The interior side 339 faces the interior of the container and is exposed to the product and internal atmosphere within the container.

When a pressure differential is applied across the valve 303 as shown in FIGS. 3 and 4, the valve head portion 305 moves from an inwardly located position (FIGS. 1 and 2) to an outwardly located position (FIGS. 3 and 4), and the slits 350 open. Flaps or petals 357 are defined by the slits 350, and the flaps or petals 357 open as shown in FIGS. 3 and 4 to permit the contents of the container to be discharged. Typically, the valve 303 can be opened in response to a pressure differential applied across the valve by sucking on the exterior of the valve and/or squeezing a flexible container to which the valve is mounted.

In one conventional form of the valve 303, the valve closes after the pressure differential across the valve is reduced to, or below, a predetermined value which is lower than the minimum pressure differential necessary for initially opening the valve 303.

The conventional valve 303 has a reduced thickness region at its center—at and adjacent the valve longitudinal axis 349. The laterally outer peripheral portion of the valve head portion 305 is thicker than the center. Such a structure has been found to provide desirable operating characteristics, including various opening characteristics and closing characteristics as more fully described in the above-identified U.S. Pat. No. 5,377,877.

While the above-discussed conventional valve 303 functions extremely well in many applications for which it is designed, there are some applications and potential uses for a dispensing valve wherein it would be desirable to provide different discharge flow characteristics. The inventor of the present invention has discovered that it would be beneficial in some applications to be able to provide multiple streams of product from a dispensing end of a closure on a container.

The inventor of the present invention has considered modifying the conventional valve 303 so as to include two or more orifices which could dispense two or more product streams simultaneously from a single valve. FIGS. 5–10 illustrate a prototype specimen of such a modified valve having three orifices, and the modified valve is designated generally by the reference number 403 in FIGS. 5–10.

The modified valve 403 has substantially the same shape and cross-sectional configuration as the conventional valve 303 discussed above with reference to FIGS. 1–4. The only difference is that the modified valve 403 has three orifices 406, each defined by four slits 450 in the valve head portion 405. Each orifice 406 defined by the slits 450 is laterally offset from the center of the valve (i.e., laterally offset from a longitudinal axis 449 passing through the center of the valve as shown in FIGS. 5 and 6). With reference to FIG. 6, it can be seen that the three orifices 406 defined by the slits 450 are necessarily located in the thicker part of the valve head portion 405. Further, some of the slits 450 or some portions of the slits 450 extend into thinner areas of the valve head portion 405, while other slits 450 or portions of the slits 450 extend into thicker areas of the valve head portion 405.

When a sufficient pressure differential is applied across the valve head portion 405 as shown in FIGS. 7 and 8, the valve head 405 moves from the inwardly recessed position to the outwardly extended position. As the pressure differential is increased, the valve orifices 406 begin to open (FIGS. 9 and 10). As shown in FIGS. 9 and 10, each orifice 406 defined by the slits 450 is surrounded by four flaps or petals 457A, 457B, 457C, and 457D. Flap 457A is closest to the center of the valve, flap 457C is furthest from the center of the valve, and flaps 457B and 457D are at intermediate positions relative to the center of the valve compared to flaps 457A and 457C.

As can be seen in FIG. 10, flap 457A can open further or wider than flap 457C because flap 457A has a thinner section 460 about which it bends compared to the thicker bending section 462 of the flap 457C. The orifice flaps may be characterized as being unbalanced and opening unequally. The flaps which are closer to the center of the valve are generally thinner and weaker, and they open further than do the flaps which are in the thicker, outer region of the valve head portion. Also, the thin central region of the valve head portion 405 tends to temporarily deform into an outwardly convex configuration so that the orifices 406 are positioned in an angled orientation relative to the valve longitudinal axis 449 such that the open flow path for the discharging product tends to be oriented at a diverging angle relative to the longitudinal axis 449. These conditions can cause the discharging product stream to be oriented at significant diverging angle relative to the longitudinal axis 449 of the valve. The product stream is schematically represented by the arrow 468 in FIG. 10.

Further, because each valve orifice 406, or part thereof, is located generally in the radially outer, thicker areas of the valve head 405, compared to a single orifice located in the central, thinner region of the valve head as in the conventional valve 303 illustrated in FIGS. 1–4, a greater differential pressure across the modified valve 403 is required to open the orifices 406 in the modified valve 403. This requires a greater effort on the part of the user who must suck harder on the outside of the valve and/or squeeze the container with greater force. This can contribute to a reduction in the flow rate of product being dispensed. This, of course, is generally not desired where a purpose of employing multiple orifices might be to increase the product flow rate.

The inventor of the present invention has discovered that it would be advantageous to provide a valve for dispensing multiple discharge streams of product which would be oriented with little or no divergence from the longitudinal axis of the valve. It would be desirable to provide a multiple orifice valve which could discharge multiple product streams in a relatively confined target area and which would not create significant diverging spray or splatter.

Such an improved valve should also facilitate ease of dispensing the product when the interior of the container is pressurized (e.g., when the container is squeezed or when the container internal pressure is increased by other means), or when suction is applied to the exterior of the valve. It would thus be beneficial if an improved valve could be provided with multiple orifices and that would not require an unduly large pressure differential to be applied across the valve in order to effect opening of the multiple orifices.

It would also be advantageous if such an improved valve could accommodate its use with bottles, containers, pouches, or packages that have a variety of shapes and that are constructed from a variety of materials.

Further, it would be desirable if such an improved valve could accommodate efficient, high-quality, large-volume manufacturing techniques with a reduced product reject rate to produce valves with consistent operating characteristics.

The present invention provides an improved dispensing valve which can accommodate designs having the above-discussed benefits and features.

BRIEF SUMMARY OF THE INVENTION

The present invention provides a valve for dispensing a product from a container, and the valve has a unique configuration that opens when the pressure differential across the valve exceeds a predetermined amount (e.g., when the container interior pressure increases to a predetermined amount relative to standard atmospheric pressure outside the container). The valve can accommodate discharge of liquids, creams, or particulate matter, including powders.

The valve is adapted for use in dispensing a product from a container having an opening. The valve may be formed as a unitary part of an end of such a container or may be mounted in a separate assembly that is permanently or releasably attached to the container.

The preferred form of the valve is adapted for being sealingly disposed with respect to, and dispensing the product from, the discharge opening of the container. The valve includes a marginal portion adapted to be sealingly engaged when the valve is sealingly disposed with respect to the container discharge opening. The valve also includes a head portion that (1) is laterally inwardly of the marginal portion, (2) has an exterior side for interfacing with ambient environment, and (3) has an interior side for interfacing with the product.

In one embodiment, the valve head portion can be characterized as having a center or center region which is at least as thick as the periphery of the head portion. The head portion includes at least one normally closed orifice that is (1) offset laterally from the center of the head portion, and (2) defined by at least one slit that extends transversely through the head portion from the exterior side to the interior side whereby (a) flaps are defined by the slit, and (b) the orifice opens by outward displacement of the flaps in response to a predetermined pressure differential across the valve.

In a presently more preferred embodiment, the valve head portion exterior side has a generally concave shape when viewed from outside the container, and the head portion interior side has a generally curved, radially outer portion which tapers toward the periphery of the valve head portion such that the periphery of the valve head portion is thinner than the center of the valve head portion.

In a presently preferred form of the valve, the valve head portion includes two or more orifices where each orifice is defined by four slits diverging radially from an origin at 90 degree angles to define two mutually perpendicular, intersecting, longer slits. Preferably, the orifices are disposed uniformly in a circular locus on the valve head portion in the thinner regions of the valve head portion.

In a preferred embodiment, the valve also has a resilient, flexible, connector sleeve having (1) a first end portion thereof connected with the marginal portion of the valve, and (2) a second end portion thereof connected with the head portion. The connector sleeve has an interior surface for interfacing with the product and has an exterior surface for interfacing with ambient environment. The first end portion of the connector sleeve has a J-shaped cross section which extends into the marginal portion to facilitate movement of the head portion when dispensing product from the container. The connector sleeve preferably has a resiliently flexible sidewall with a configuration which extends rollingly to shift the valve head portion outwardly when the pressure differential across the valve increases above a predetermined amount.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same.

FIG. 3 is a view similar to FIG. 1, but FIG. 3 shows the valve in the fully opened condition;

FIG. 4 is a cross-sectional view taken generally along the plane 4—4 in FIG. 3;

DETAILED DESCRIPTION

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, the dispensing valve of this invention is described in the typical orientation that it would have at the end of a container, and terms such as upper, lower, horizontal, etc., are used with reference to this position. It will be understood, however, that the dispensing valve of this invention may be manufactured, stored, transported, used, and sold in an orientation other than the positions described.

The dispensing valve of this invention is suitable for use with a variety of conventional or special containers and closures having various designs, the details of which, although not illustrated or described, would be apparent to those having skill in the art and an understanding of such containers and closures. The container per se (and closure, if used) forms no part of the present invention.

Figure 11:
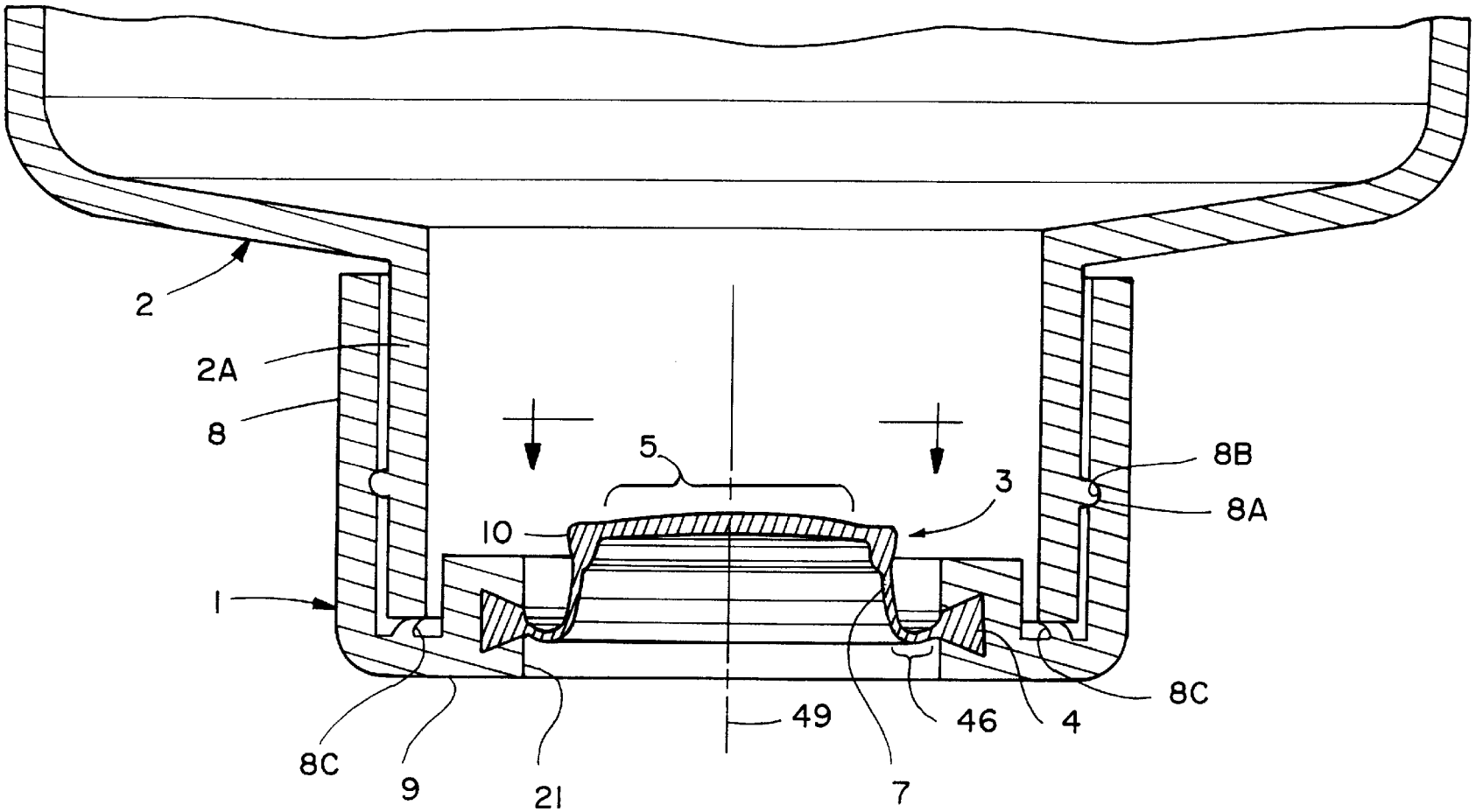
FIG. 11 is a fragmentary, cross-sectional view of a valve of the present invention which is formed separately from, but which is releasably or permanently mounted to, a container which has been turned over in an inverted orientation prior to dispensing a product from the container through the valve.

The presently preferred embodiment of the dispensing valve is generally designated in the figures by the reference number 3. Valve 3 is mounted in a dispensing closure 1 for a container 2 as shown in FIG. 11, but may be mounted directly to a container as discussed hereinafter. As can be seen in FIG. 11, closure 1 has a base or skirt 8, and an annular shoulder 9 extending radially inwardly from the top of skirt 8 to define an opening 21.

As can be seen in FIG. 11, skirt 8 is adapted to receive the upper end of a neck 2A of container 2. Neck 2A has a snap-fit bead 8A for engaging a mating groove 8B in the closure skirt 8. Closure 1 could also be threadingly engaged with container 2 or could be permanently fixed to container 2 by means of induction melting, ultrasonic melting, gluing, or the like, depending on the materials used for the closure and the container.

Closure 1 could also be formed as a unitary part, or extension, of container 2. In some applications, it may be desirable to eliminate closure 1 altogether, and instead attach valve 3 directly to a neck or spout of container 2 or to some other structural feature of a container which defines an opening. Valve 3 could be attached directly to container 2 with adhesive, or with bi-injection molding, or as a structure unitarily molded with container 2, or with other suitable means.

Closure skirt 8 may have any suitable configuration. Container 2 could have any suitable structure, such as the neck 2A, for being received within the particular configuration of closure 1, and the main part of container 2 may have a cross-sectional shape different from the container neck and closure skirt 8.

Closure 1 is adapted to be used with a container having a mouth or other opening to provide access to the container interior and to a product contained therein. The product may be, for example, a liquid comestible product. The product could also be any other liquid, solid, or gaseous material, including, but not limited to, a powder, particulate material, a food product, a personal care product, an industrial or household cleaning product, or other chemical compositions (e.g., compositions for use in activities involving manufacturing, commercial or household maintenance, construction, agriculture, etc.).

Container 2 would typically be a squeezable container having a flexible wall or walls which can be grasped by the user and squeezed or compressed to increase the internal pressure within the container so as to force the product out of the container and through closure 1. The container wall typically has sufficient, inherent resiliency so that when the squeezing forces are removed, the container wall returns to its normal, unstressed shape. Such a squeezable wall structure is preferred in many applications but may not be necessary or preferred in other applications. For example, in some applications it may be desirable to employ a generally rigid container and pressurize the container interior at selected times with a piston or other pressurizing system. It may also be desirable to employ a generally rigid container and to employ suction on the exterior of the valve to open the valve.

A conventional, annular, "crab's claw" seal 8C, or other type of conventional or special seal, is preferably provided to project inwardly from the inside of closure 1 to sealingly engage an annular portion of neck 2A of container 2 adjacent the opening in container 2.

Valve 3 is retained within closure 1. In a presently preferred embodiment, closure 1 is molded from a thermoplastic material (such as polypropylene) in a first configuration for subsequently receiving valve 3. Portions of closure 1 are subsequently permanently deformed around a peripheral margin of valve 3 to clamp valve 3 in place in closure 1 in sealing engagement. Alternative clamping structures, such as a separate snap ring, could be employed instead.

Figure 12:
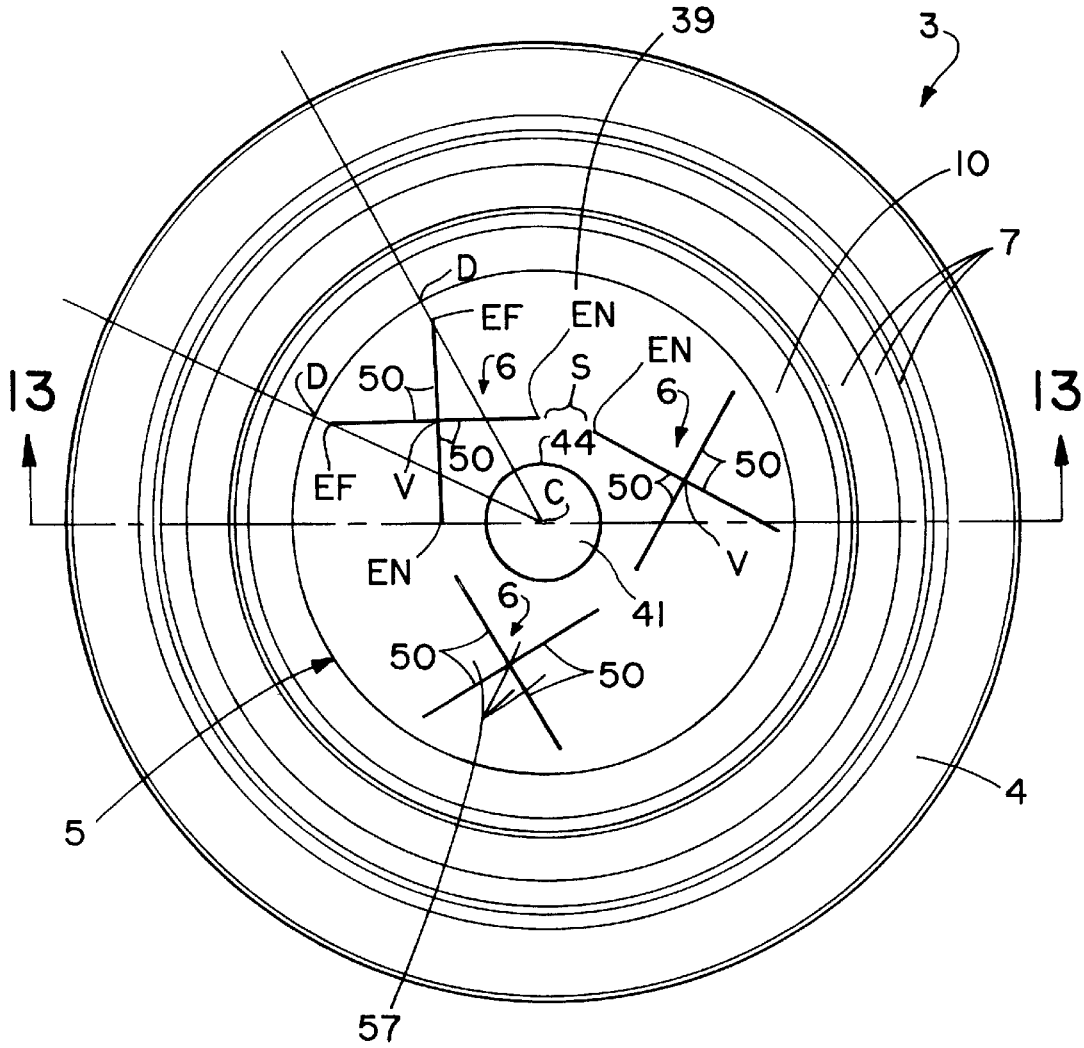
FIG. 12 is a plan view of the valve shown in FIG. 11 as viewed from the exterior of the container, but with the container components not shown so that the entire valve is visible.
Figure 13:
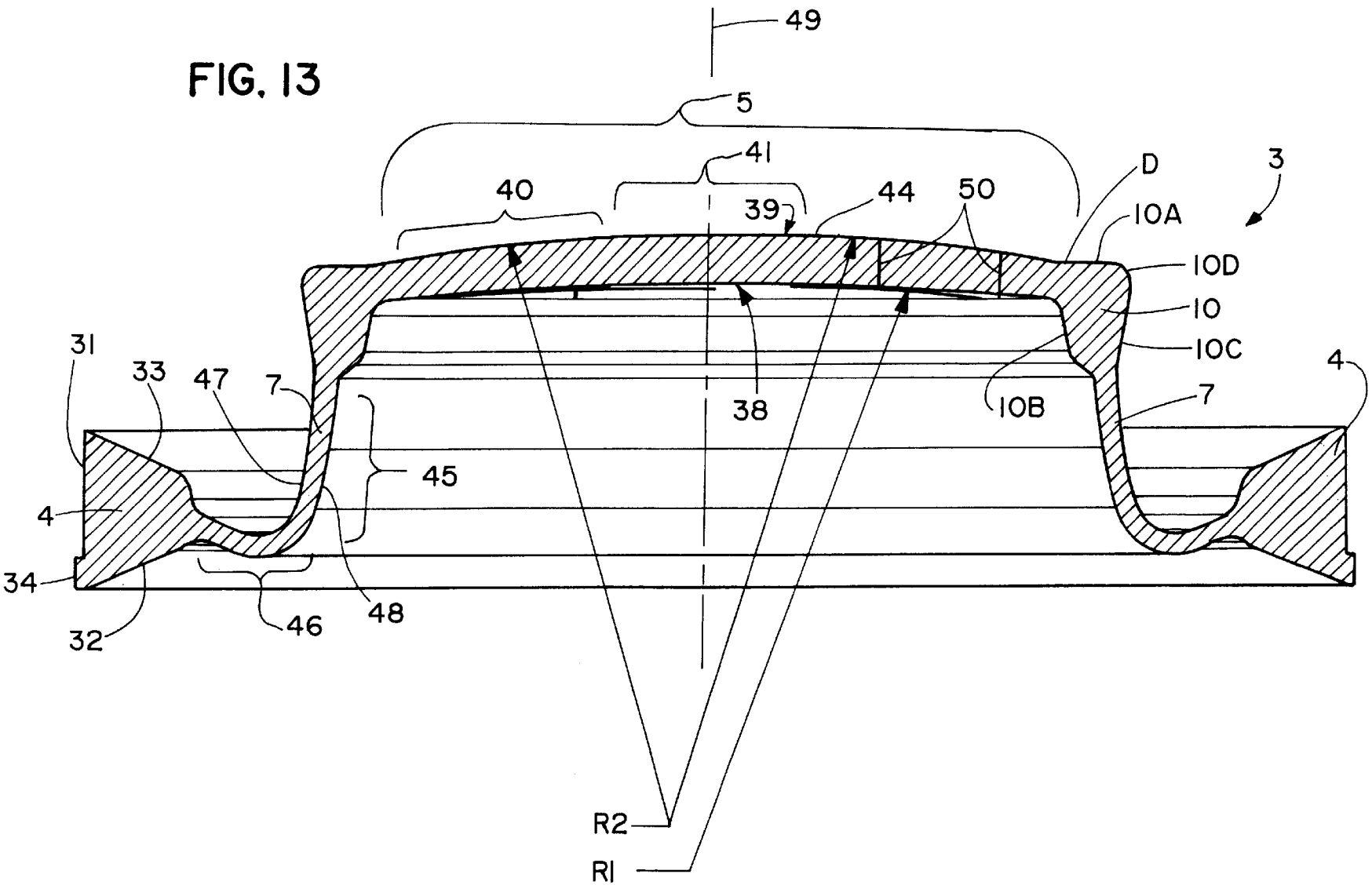
FIG. 13 is a cross-sectional view taken generally along the plane 13—13 in FIG. 12.

As shown in FIGS. 12 and 13, valve 3 includes a marginal flange 4, a valve head 5 with three discharge orifices 6 (FIG. 12) therein, and a connector sleeve 7 which has one end connected with valve flange 4 and which has the opposite end connected through an annular shoulder 10 with valve head 5 adjacent a marginal edge thereof. Connector sleeve 7 has a resiliently flexible construction, such that when a sufficient pressure differential is applied across valve 3, valve head 5 shifts outwardly (FIGS. 14 and 15) in a manner which causes connector sleeve 7 to double over and then extend rollingly to a fully extended position where valve 3 becomes fully opened to accommodate discharge of the container contents.

With reference to FIG. 13, the illustrated dispensing valve 3 has an integrally formed, or unitary, one-piece construction. Valve 3 has an interior side which interfaces with the fluid product in container 2. Valve 3 has an oppositely oriented exterior side which interfaces with ambient environment. Valve 3 is preferably molded from a resiliently flexible material, and in the illustrated example the material comprises a silicone rubber which is substantially inert so as to avoid reaction with, and/or adulteration of, the product being packaged. In one contemplated method of manufacturing valve 3 of the present invention, valve 3 is produced at relatively high speeds by the molding of liquid silicone rubber or thermoplastic elastomers.

In the illustrated preferred embodiment, marginal flange 4 (FIG. 12) of valve 3 has an annular plan shape, and valve flange 4 has a substantially dove-tail transverse cross-sectional configuration comprising an outer edge defined by a cylindrical wall 31 with an outer rim 34 upstanding therefrom, an outer or first frustoconical surface 32, and an inner or second frustoconical surface 33. Marginal valve flange 4 has substantial thickness between the outer, or first, frustoconical surface 32 and the inner, or second, frustoconical surface 33, which thickness is resiliently compressed upon deformation of a portion of closure 1 (FIG. 11) to form a secure leak-resistant seal therebetween.

In the preferred embodiment, the valve 3 has a head portion 5 (FIG. 12) which has a circular plan shape, and a generally tapered construction which is thinner at the radially outside portion of valve head 5, and thicker at the radially inside portion thereof. However, in some applications, the center portion and outer portion of the valve head portion 5 may have the same thickness. The preferred construction assists in achieving the preferred opening action of the valve as described below. More specifically, in the illustrated example shown in FIG. 13, valve head 5 has an exterior side or surface 38 for interfacing with the ambient environment. Surface 38 preferably has an arcuately shaped side elevational configuration which opens or curves outwardly, toward the exterior of container 2, and surface 38 is defined by first, predetermined radius $R_1$ (FIG. 13). Valve head exterior surface 38 extends continuously to the interior of shoulder 10 which extends from the periphery of head 5 to sleeve 7.

Valve head 5 also includes an interior side or surface 39 (FIG. 13) for interfacing with the product in container 2. Surface 39 has an annular marginal portion 40 that preferably has an arcuately shaped side elevational configuration which opens or curves outwardly, toward the exterior of the container 2, and is defined by a second predetermined radius $R_2$. Radius $R_2$ of marginal portion 40 on interior surface 39 is smaller than radius $R_1$ of exterior surface 38, such that the two surfaces 38 and 39 converge toward the periphery of valve head 5 at shoulder 10 to provide the above-noted inwardly tapered construction of valve head 5. Radius $R_1$ and radius $R_2$ may each be characterized as a spherical radius.

In the preferred form, interior surface 39 of valve head 5 also includes a center portion or planar central area 41 (FIG. 13), which has a circular plan shape, with a substantially planar or flat side elevational configuration, oriented generally perpendicularly to a longitudinal axis 49 of the valve 3. The boundary of marginal portion 40 and planar central portion 41 of valve head 5 defines a circular edge 44 (FIG. 12). Planar central portion 41 of valve head 5 assists in improving the opening characteristic of valve 3, as discussed below.

In the preferred form of valve 3, the outer perimeter of valve head 5 is defined by an outer diameter D (FIGS. 12 and 13). Shoulder 10 extends radially outwardly from diameter D.

The shoulder 10 is thicker than the peripheral margin of valve head portion 5 at diameter D. Shoulder 10 includes a flat annular surface 10A which faces inwardly into container 2 and which extends radially or laterally from the valve head interior surface 39. Shoulder 10 also includes a generally frustoconical internal surface 10B which extends from the exterior side 38 of valve head portion 5. Shoulder 10 also includes a frustoconical marginal surface 10C which extends downwardly from the surface 10A with a slight taper to ultimately merge with connector sleeve 7. Such a configuration may be characterized as defining a laterally outwardly flared crown shape with a tapered peripheral surface 10C, and this shape prevents valve 3 from nesting with another, identical valve 3 during handling.

The radially outermost portion of shoulder 10 is a radius corner or edge 10D which defines the largest diameter of shoulder 10, and that largest diameter is substantially smaller than the inside diameter of marginal flange 4, as measured along the inner edge of the flange 4 where it connects with sleeve 7. This spacing between valve head 5 and marginal flange 4 permits valve head 5 to shift freely in an axial direction through the center of marginal flange 4, during opening and closing of the valve as explained in detail hereinafter.

Connector sleeve portion 7 illustrated in FIGS. 12 and 13 is in the form of a rolling diaphragm, having a hollow circular plan configuration, and a generally J-shaped longitudinal cross-sectional shape. Sleeve 7 includes a cylindrical sidewall portion or sidewall 45 (FIG. 13) and a radially outwardly extending base portion 46 (FIG. 13). Connector sleeve 7 has interior and exterior surfaces 47 and 48 (FIG. 13), respectively, which, in the preferred embodiment, are spaced generally equidistantly apart along the length thereof, such that connector sleeve 7 has a substantially uniform thickness. One end portion of connector sleeve 7 is connected with shoulder 10 adjacent the surfaces 10B and 10C thereof, and the opposite end portion of connector sleeve 7 is connected with the valve marginal flange 4.

Interior surface 47 of connector sleeve 7 has an inner end which merges, and is contiguous with, shoulder 10, while the opposite end of connector sleeve 7 is connected with the valve marginal flange 4 such that base portion 46 of connector sleeve 7 flares in a radially inwardly direction from flange 4 and also protrudes outwardly toward the valve exterior in an arcuate configuration. The arcuately flared shape of connector sleeve base portion 46 assists connector sleeve 7 in first doubling over, and then rollingly extending, as valve head 5 shifts outwardly in the manner described in greater detail below. The marginal attachment of the inner end of connector sleeve 7 to valve head 5 through shoulder 10, as well as the associated geometry of sleeve 7, is believed to increase the effectiveness of torque forces which assist in snapping valve 3 open, as discussed hereinafter.

In the illustrated preferred embodiment of valve 3 shown in FIG. 13, the exteriormost area of sleeve arcuate base portion 46 is disposed slightly interior of the axially outermost part of marginal flange 4 so as to facilitate fabrication. The length of connector sleeve 7 is preferably selected to be sufficiently short so as to prevent sleeve 7 from folding in behind valve head 5 when valve head 5 is in the fully extended position (FIGS. 14–15), thereby avoiding interference with the reaction of valve head 5, which is explained in detail below.

The illustrated one-piece valve 3 preferably has a generally hat-shaped side elevational configuration in its original, as-molded, normal condition, wherein valve head 5 assumes a generally concave shape (FIGS. 11 and 12). The resilient flexibility of connector sleeve 7 permits sleeve 7 to double over and then extend rollingly in the manner described hereinafter. Connector sleeve 7 acts as a rolling diaphragm with valve head 5 mounted at the center thereof in a manner which permits valve head 5 to shift or float freely inwardly and outwardly in an axial direction with respect to the opening 21 in closure 1.

In many applications, it is preferable to provide an overcap or cover (not illustrated) for closure 1. This may include a removable foil or other membrane seal (not illustrated) over opening 21 in the top of closure spout 10. Alternatively, a generally rigid overcap (not illustrated) could be mounted to closure 1 (e.g., with a tamper-evident tear-away band or with a threaded mounting arrangement, etc.). Any suitable special or conventional overcap or sealing system may be employed, the details of which form no part of the present invention.

In the illustrated preferred embodiment, valve 3 has a generally circular configuration about a longitudinal axis 49 (FIGS. 11 and 13), and orifices 6 are each laterally offset from axis 49 and the center of the valve head portion 5. Each orifice 6 is defined by at least one slit 50. Preferably, each orifice 6 is defined by four slits 50. Slits 50 extend transversely through head portion 5 from exterior side or surface 38 to interior side or surface 39.

Figure 1:
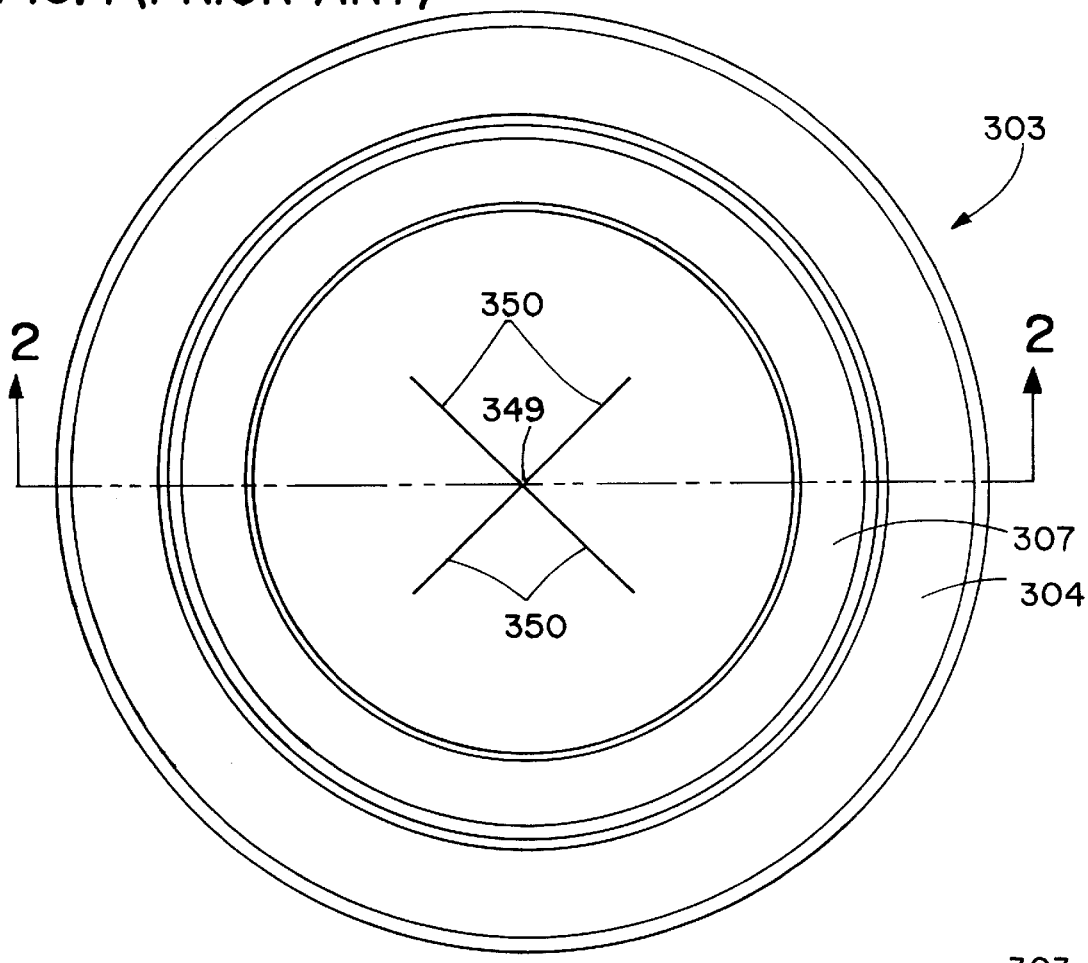
FIG. 1 (PRIOR ART)
FIG. 1 is a top plan view of a conventional flexible, resilient, slit-type valve as viewed from the exterior side of the valve that would normally face outwardly from a container on which the valve is mounted and that would be exposed to exterior ambient atmosphere.
Figure 2:
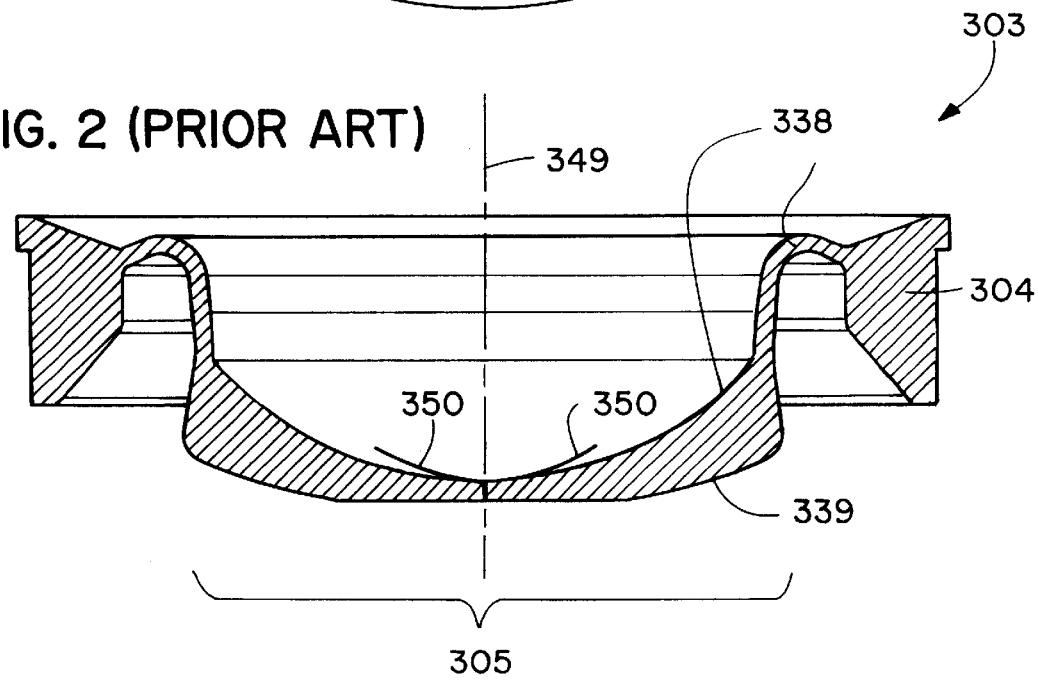
FIG. 2 (PRIOR ART)
FIG. 2 is a cross-sectional view taken generally along the plane 2—2 in FIG. 1.
Figure 5:
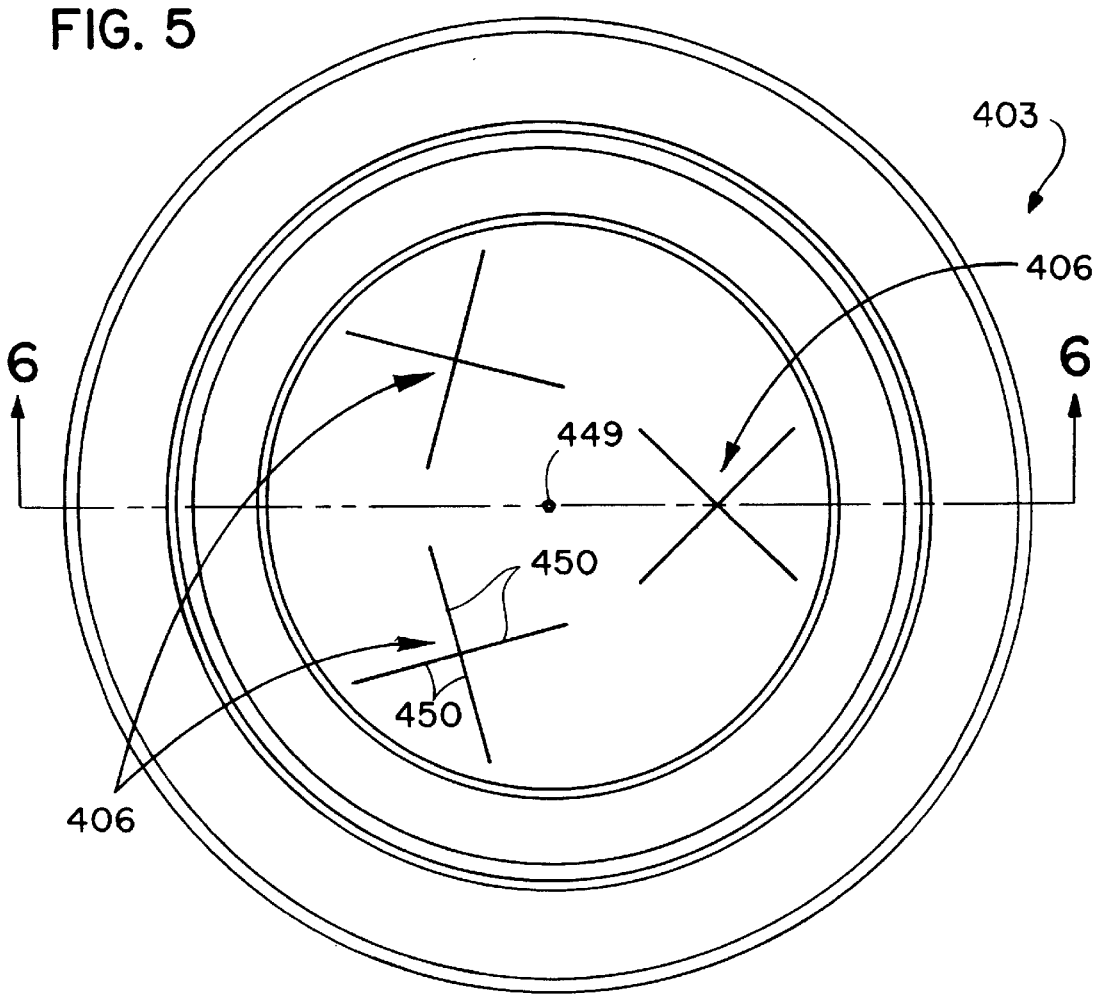
FIG. 5 is a view similar to FIG. 1, but FIG. 5 shows a modification of the conventional valve to include three dispensing orifices.
Figure 6:
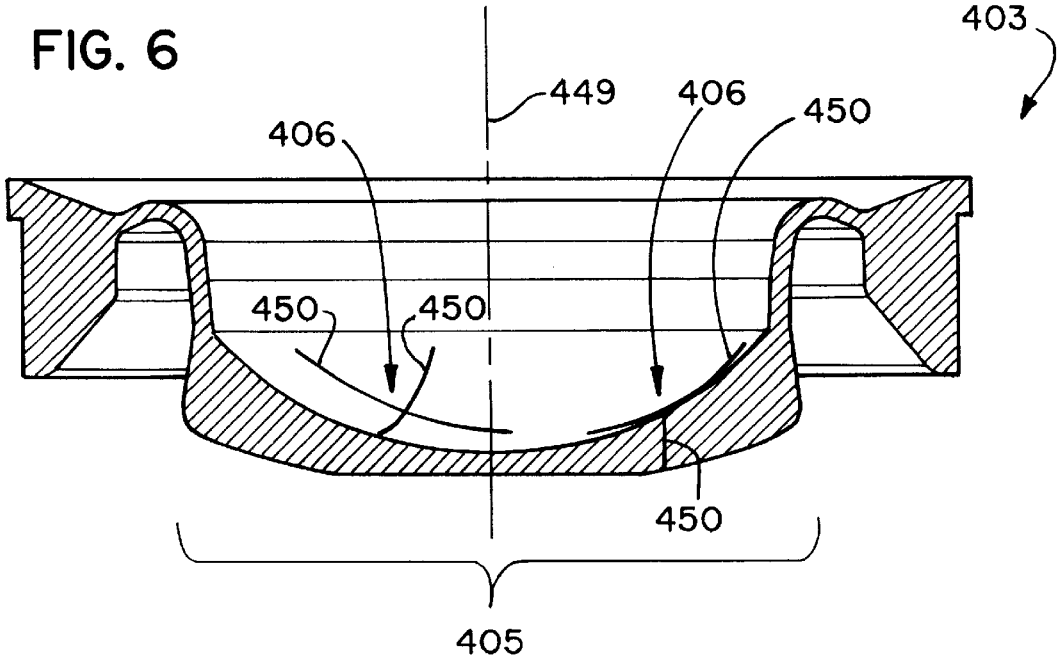
FIG. 6 is a cross-sectional view taken generally along the plane 6—6 in FIG. 5.

In the illustrated preferred embodiment, slits 50 at each orifice 6 extend laterally from a common origin to define four flaps 57 (FIG. 2) which flex outwardly to selectively permit the flow of product from container 2 through valve 3. Each slit 50 terminates in a distal end.

FIG. 12 illustrates three orifices 6 in plan view wherein each slit 50 extends from a common origin or vertex V at an orifice 6. At each orifice 6, two of the slits 50 terminate in distal ends designated EF which are relatively close to the outer diameter D of the valve head portion 5, and two of the slits 50 terminate in distal ends designated EN which are not as close to the valve head portion outer diameter D. Preferably, as can be seen in FIG. 12, the three orifices 6 are arranged on a circular locus around the center of valve head portion 5 equidistant from each other at 120 degree intervals, and the two slit ends EF at each orifice 6 are equidistant from the head portion outer diameter D while the other slit distal ends EN are also equidistant, but further, from the head portion outer diameter D.

Preferably, as illustrated in FIG. 12, the longitudinal axis through the valve 3 can be characterized as establishing a center C in plan view. The radial distance between the center C and each slit distal end EF is preferably the same. Similarly, the radial distance between the valve center C and each slit distal end EN is preferably the same, although a shorter distance than the distance between center C and the distal ends EF.

Preferably, the distance S between the end of a slit 50 at one orifice 6 and the end of a corresponding slit at an adjacent orifice 6 is uniform or equal for each adjacent pair of orifices. In one presently contemplated preferred embodiment, as illustrated in FIG. 12, the distance S between one orifice slit end EN and an adjacent orifice slit end EN is about 0.050 inch minimum. The radial distance between an orifice slit distal end EF and the diameter D of the valve head 5 may be about the same, may be greater, or may be less than the distance S.

In the preferred embodiment, each slit 50 is planar in its transverse orientation through valve head 5. Each slit 50 preferably defines a linear locus along the head portion interior side 39 (FIG. 12), as well as along exterior side 38 (FIG. 13). Preferably, slits 50 at each orifice 6 diverge from an origin or vertex V to define equal size angles between each pair of adjacent slits 50 so that flaps 57 are of equal size. Preferably, four slits 50 diverge at 90° angles to define two mutually perpendicular, intersecting, longer slits. Slits 50 are preferably formed by slicing through the valve head 5, without removing any substantial amount of material therefrom, so that the opposing side faces of adjacent valve flaps 57 closely seal against one another when discharge orifice 6 is in its normal, fully closed position. The length and location of slits 50 can be adjusted to vary the predetermined opening pressure of valve 3, as well as other dispensing characteristics.

It is to be understood that orifice 6 may assume many different shapes, sizes and/or configurations in accordance with those dispensing characteristics desired. For example, orifice 6 may have only one slit or may include five or more slits, particularly when larger or wider streams are desired, and/or the product is a particulate material or a liquid containing aggregates.

Dispensing valve 3 is preferably especially configured for use in conjunction with a particular container 2, and a specific type of product, so as to achieve the exact dispensing characteristics desired. For example, the viscosity and density of the fluid product are both important factors in designing the specific configuration of valve 3 for liquids, as is the shape, size, and strength of container 2 if the container 2 is a squeezable container. The rigidity and durometer of the valve material, and size and shape of both valve head 5 and connector sleeve 7, are also important in achieving the desired dispensing characteristics, and can be matched with both container 2 and the substance or product to be dispensed therefrom. Valve 3 is suitable for dispensing flowable products, such as liquids or even powder, particulates, or granular material, as well as suspensions of solid particles in a liquid.

It is to be understood that, according to the present invention, valve 3 may assume different shapes and sizes, particularly in keeping with the type of container 2 and product to be dispensed therefrom. The predetermined pressure differential for opening valve 3 may be varied widely in accordance with those dispensing criteria desired for a particular product. Flow characteristics of the dispensed product can also be adjusted substantially, such as for relatively wide column-like streams, thin needle-like streams, and the like.

In operation, closure 1 functions in the following manner. Valve 3 normally assumes the inwardly protruding orientation illustrated in FIG. 4, wherein valve 3 remains substantially in its original molded shape without deformation, with connector sleeve 7 being fully retracted and with the discharge openings 6 being fully closed. When valve 3 is mounted in the end of container 2, as is shown in FIG. 11, valve 3 is configured such that discharge orifices 6 will remain securely closed after container 2 is inverted, even though the valve 3 is subjected to the hydraulic head pressure of the fluid product when the container 2 is completely full.

The process for opening the valve 3 outwardly requires that a pressure differential be established across the valve—with the pressure on the interior of the valve being greater than the pressure on the exterior of the valve. This could be effected by establishing a suction or reduced pressure at the valve exterior. For example, if the valve was mounted in the opening or spout of a drink bottle or other container, then the user could lift the bottle, tilt it toward the mouth, and suck on the spout to establish a differential pressure sufficient to open the valve. Alternatively, if the bottle is squeezable, then the user can either (1) merely squeeze the bottle to increase the pressure on the interior of the valve, or (2) both suck on the spout and squeeze the bottle at the same time.

Figure 14:
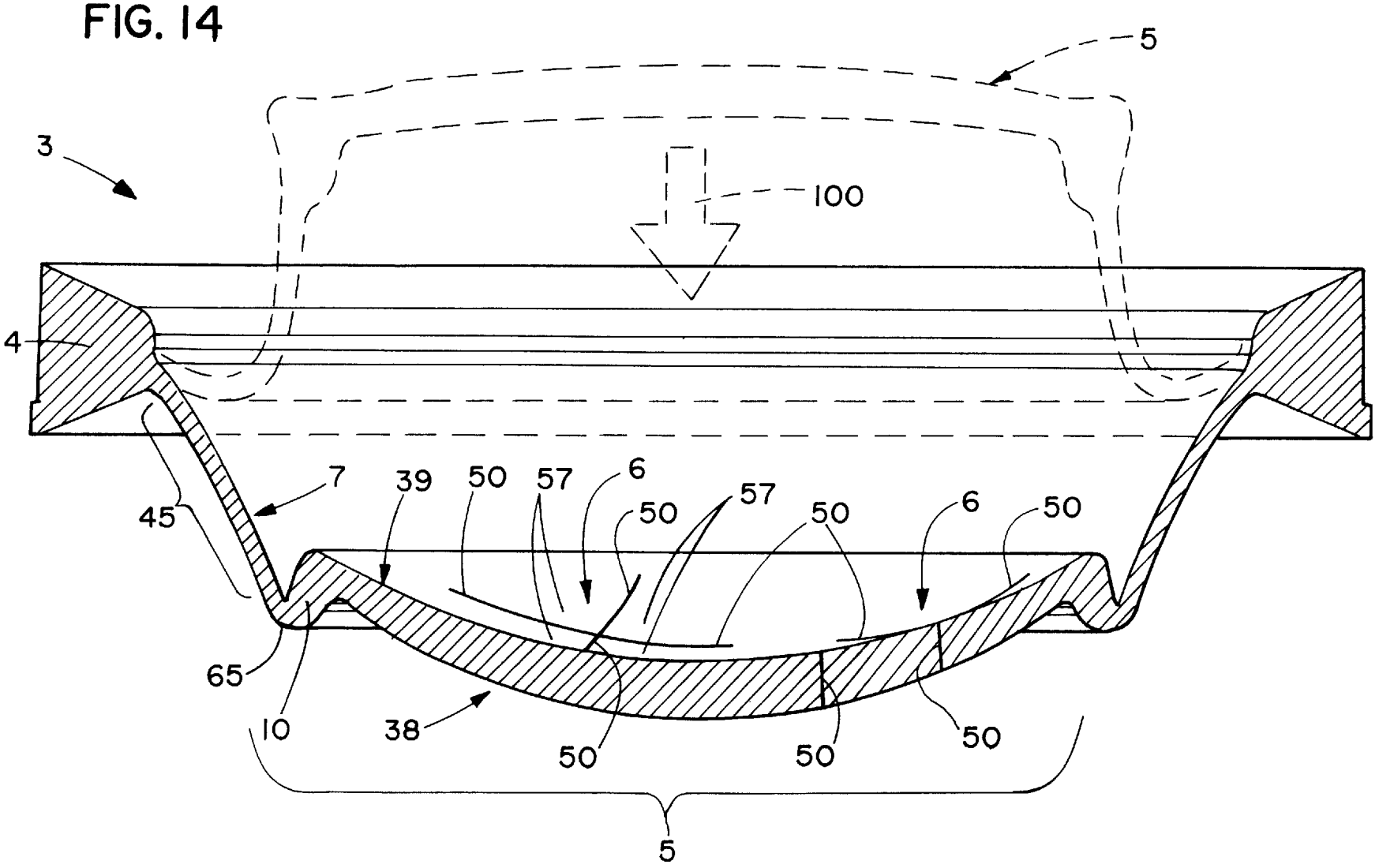
FIG. 14 is a view similar to FIG. 13, but FIG. 14 shows a moved position of the valve after it has been pressurized so as to force the head portion to an outwardly extending configuration, just prior to the valve orifices opening.

When a sufficient additional pressure differential is established across the valve, connector sleeve 7 functions as a rolling diaphragm, and permits valve head 5 to begin shifting axially outwardly (in the direction of arrow 100 in FIG. 14) toward the exterior of dispensing closure 1 by doubling over connector sleeve 7, which then in turn, begins to extend outwardly in a rolling fashion, as illustrated in FIG. 14. The outwardly protruding J-shaped configuration of connector sleeve 7 (FIG. 14) assists in initiating this rolling motion of connector sleeve 7.

While not intending to be bound by any particular theory of operation and analysis, the following description of operation is offered by way of explanation as the invention is presently understood. The elastic deformation of connector sleeve 7 from its molded shape (FIG. 4) is believed to generate a complex pattern of stresses within valve 3 which tends to resiliently urge valve 3 back into its original or normal configuration. Such stresses are believed to also include an outwardly directed torque applied by connector sleeve 7 and shoulder 10 to valve head 5, and this torque tends to resiliently urge the discharge orifices 6 toward their open positions, as described in greater detail below.

When the pressure differential across the valve 3 is increased further, as by establishing more suction on the valve exterior or by increasing the pressure in the container 2, as illustrated in FIG. 14, valve head 5 continues to shift axially outwardly by rolling connector sleeve 7 over upon itself. The valve head 5 passes through the center of marginal valve flange 4.

When the pressure differential across the valve 3 is increased further, as by establishing more suction on the valve exterior or by increasing the pressure in the container 2 (FIG. 11), valve head 5 continues to extend outwardly relative to the exterior of dispensing closure 1 until connector sleeve 7 is substantially fully extended toward the final position illustrated in FIG. 14. When valve head 5 is in the substantially fully extended position, it is believed that the forces built up in connector sleeve 7 cause the sidewall portion 45 of connector sleeve 7 to assume a generally frustoconical shape which is generally concentric with the valve head 5. Sidewall 45 of connector sleeve 7 is folded out—perhaps 100–180 degrees from its original molded shape. The end of sleeve 7 and shoulder 10 adjacent valve head 5 may be characterized as defining an exterior lip or rim 65 when valve 3 is in the substantially fully extended position.

When the pressure differential across the valve is increased further, as by establishing more suction on the valve exterior or by increasing the pressure in the container 2, valve head 5 continues to shift outwardly toward the final position illustrated in FIG. 14. However, because connector sleeve 7 is substantially fully extended, further outward shifting of valve head 5 longitudinally tensions or stretches connector sleeve 7, thereby increasing the outwardly directed torque applied to valve head 5. Also, the further outward movement of valve head 5 tends to first flatten or straighten valve head 5 as valve head 5 moves from the concave configuration (FIG. 13) toward an outwardly bowed, convex configuration (solid lines in FIG. 14). This is believed to generate another complex pattern of stresses within valve 3. Due to the tapered shape of valve head 5, some compression strain is believed to take place adjacent the thinner, peripheral, laterally outer portion of valve head 5. When connector sleeve 7 is in the substantially fully extended position, but before valve head 5 assumes the outwardly bowed configuration shown in FIG. 14, if the pressure differential across the closed valve is further increased, then valve head 5 continues to shift outwardly by further longitudinal stretching of connector sleeve 7. The valve exterior rim 65 may also move slightly axially outwardly and radially outwardly toward the final position shown in the solid lines in FIG. 14. The shoulder 10 and marginal portion of valve head 5 is shown bent or elastically deformed inwardly as a consequence of the torque forces applied thereto by connector sleeve 7.

The above-described combined forces and motions also serve to further place valve head 5 into an unstable condition before the valve head 5 reaches the outwardly bowed, convex configuration shown in solid lines in FIG. 14. It is theorized that the combined forces acting on valve head 5 will, upon application of any additional outward force on the interior side 39 of valve 3, cause valve 3 to quickly bow outwardly to the configuration shown in solid lines in FIG. 14, and then also quickly open outwardly by the separation of valve flaps 57 at each orifice 6 in the manner illustrated in FIGS. 15–16, and thereby dispense the product in discharge streams 18 through the discharge orifices 6 (FIG. 16).

As valve 3 passes through the unstable state between the inwardly concave configuration shown in FIG. 13 and the outwardly bowed convex configuration shown in solid lines shown in FIG. 14, it is believed that the combined forces acting on valve head 5 are in a temporary, unstable condition of equilibrium for a given moment, and then quickly shift valve head 5 into a generally convex shape, simultaneously opening orifices 6.

Figure 15:
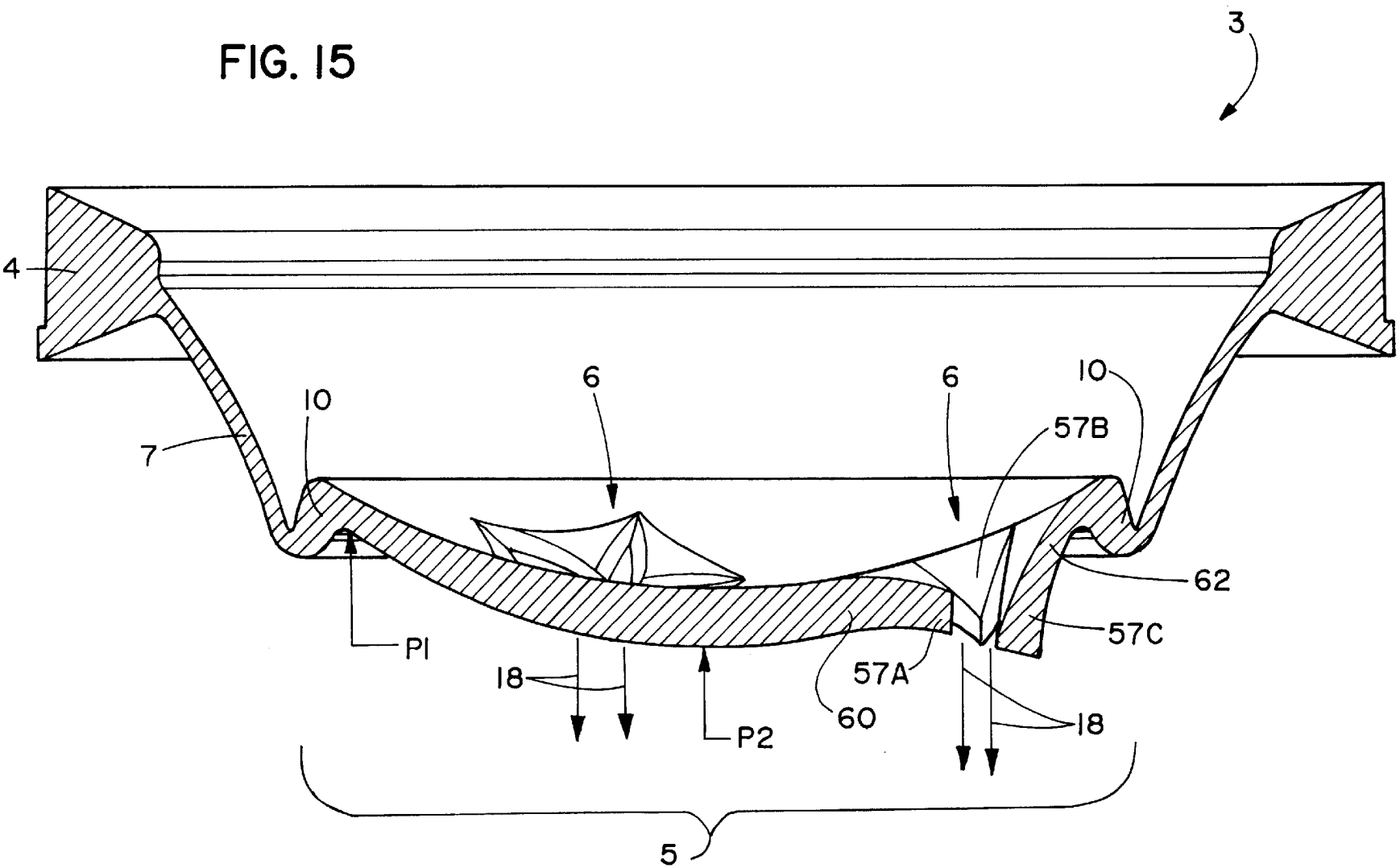
FIG. 15 is a view similar to FIG. 14, but FIG. 15 shows the final, full open condition of the valve.
Figure 16:
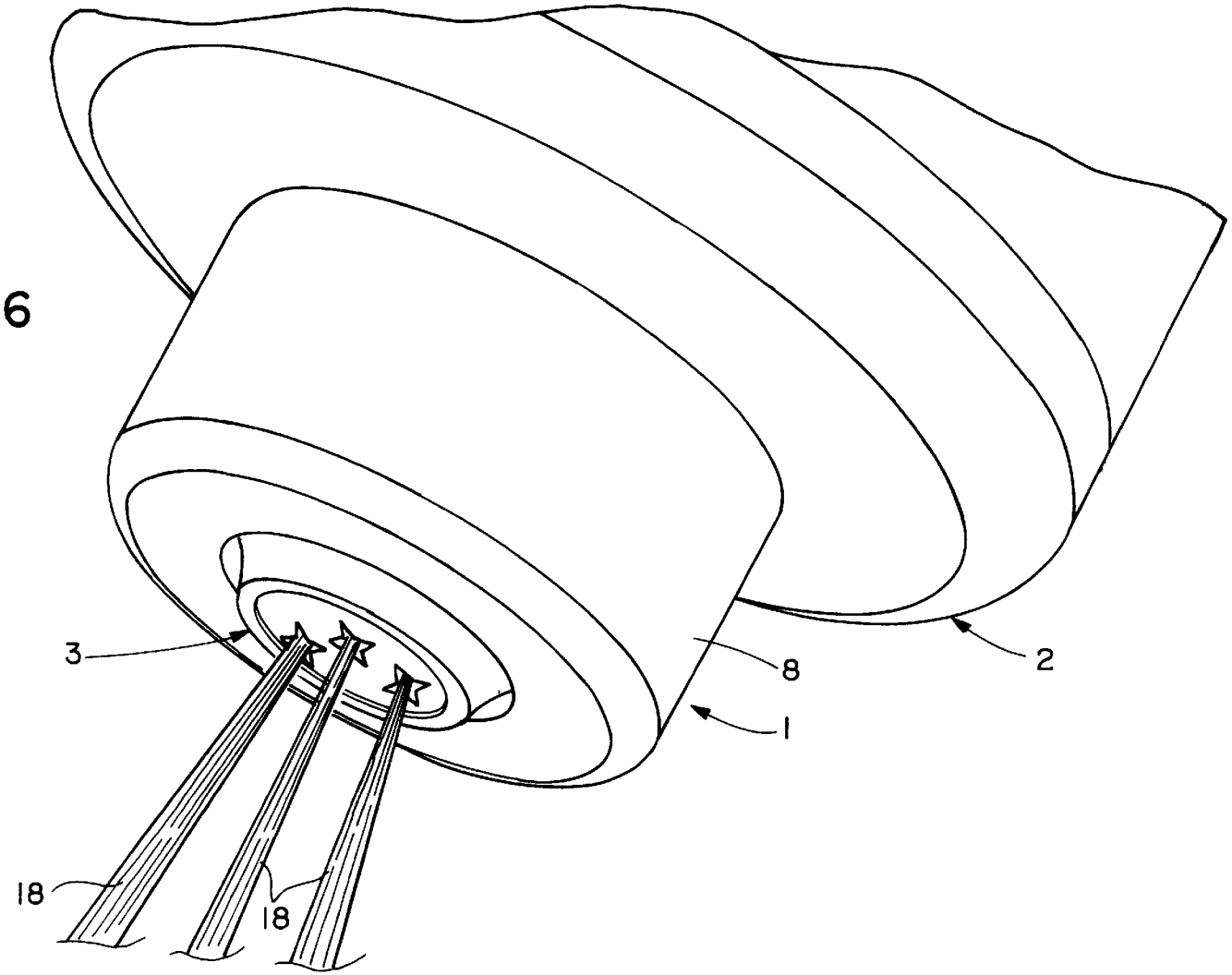
FIG. 16 is a fragmentary, perspective view of the fully opened valve mounted on a container and discharging product therefrom in three individual product discharge streams.

FIG. 15 illustrates open valve flaps 57A, 57B, and 57C, for one of the open orifices 6. The valve flap 57C closest to the outer periphery of the valve head 5 is bent open to a greater extent than the adjacent valve flap 57B or the 180 degree opposite valve flap 57A. All of the valve flaps are located in a radially or laterally outer portion of the valve head which is thinner than the central portion of valve head 5. The valve flaps, being generally thinner than if they were located at the center of valve head 5, will open at a lower pressure differential than if the valve flaps were located in the thicker central portion of valve head 5.

Because the orifice flaps which are closest to the radial periphery of valve head 5 are in a thinner region of valve head 5, such flaps (e.g., flap 57C) will bend more, and open more than the flaps which are closer to the central portion of the valve (such as flap 57A). This opening configuration tends to direct the discharge stream of product from the container through the valve in a direction that has minimum divergence or no divergence from the longitudinal axis of the valve.

It will be appreciated that when the valve 3 is fully open as illustrated in FIG. 15, the laterally most outwardly valve flaps, such as flap 57C, bend about a relatively thin region designated by reference number 62 in FIG. 15, whereas the most radially inwardly flaps, such as flap 57A, bend about a much thicker section of material designated in FIG. 15 by reference number 60. Because the section of material at point 60 is so much thicker than the section of material at point 62, valve flap 57A cannot be forced outwardly by the differential pressure as much as flap 57C. Accordingly, the end of flap 57C extends further outwardly than the end of flap 57A so as to direct the product full stream 18 in a direction that has no, or only a minimum, diverging angle relative to the longitudinal axis of valve 3.

The flow from a plurality of orifices 6 in valve head 5 produces an overall discharge flow which has little or no divergence. As shown in FIG. 16, the flow comprising the product streams 18 is thus focused in a relatively small target area. The amount of divergence of the flow may be increased or decreased by appropriate design of the valve structural parameters, such as the relative thickness of the central region of valve head portion 5 and of the laterally outward peripheral region of valve head portion 5.

For example, with reference to FIG. 15, a presently contemplated preferred range of the ratio of the thickness of valve head portion 5 at the outer diameter point P1 to the thickness of valve head portion 5 at the center point P2 is between about 1.0 to 1.0 and about 0.2 to 1.0. A more presently preferred ratio of the thicknesses at P1 and P2 is 0.6 to 1.0. Other ratios may be employed.

Figure 8:
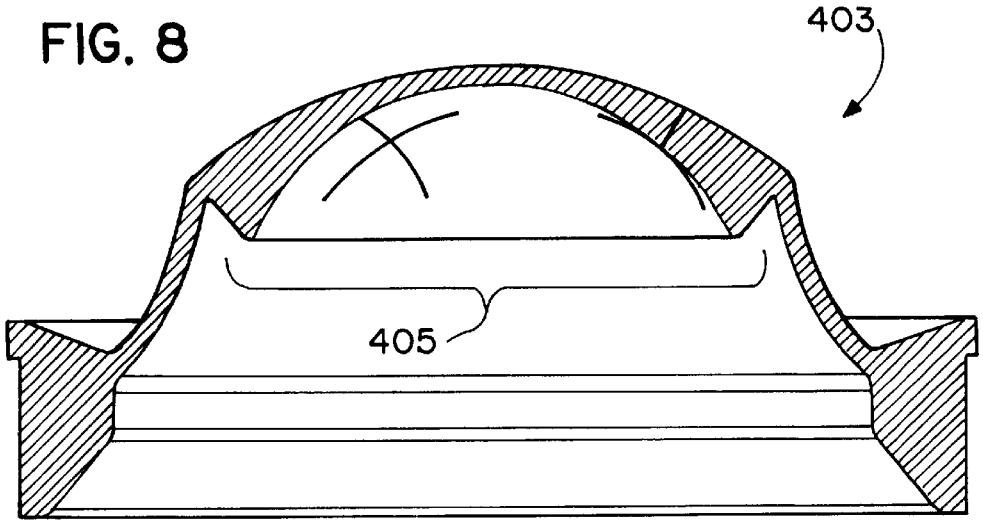
FIG. 8 is a cross-sectional view taken generally along the plane 8—8 in FIG. 7.
Figure 9:
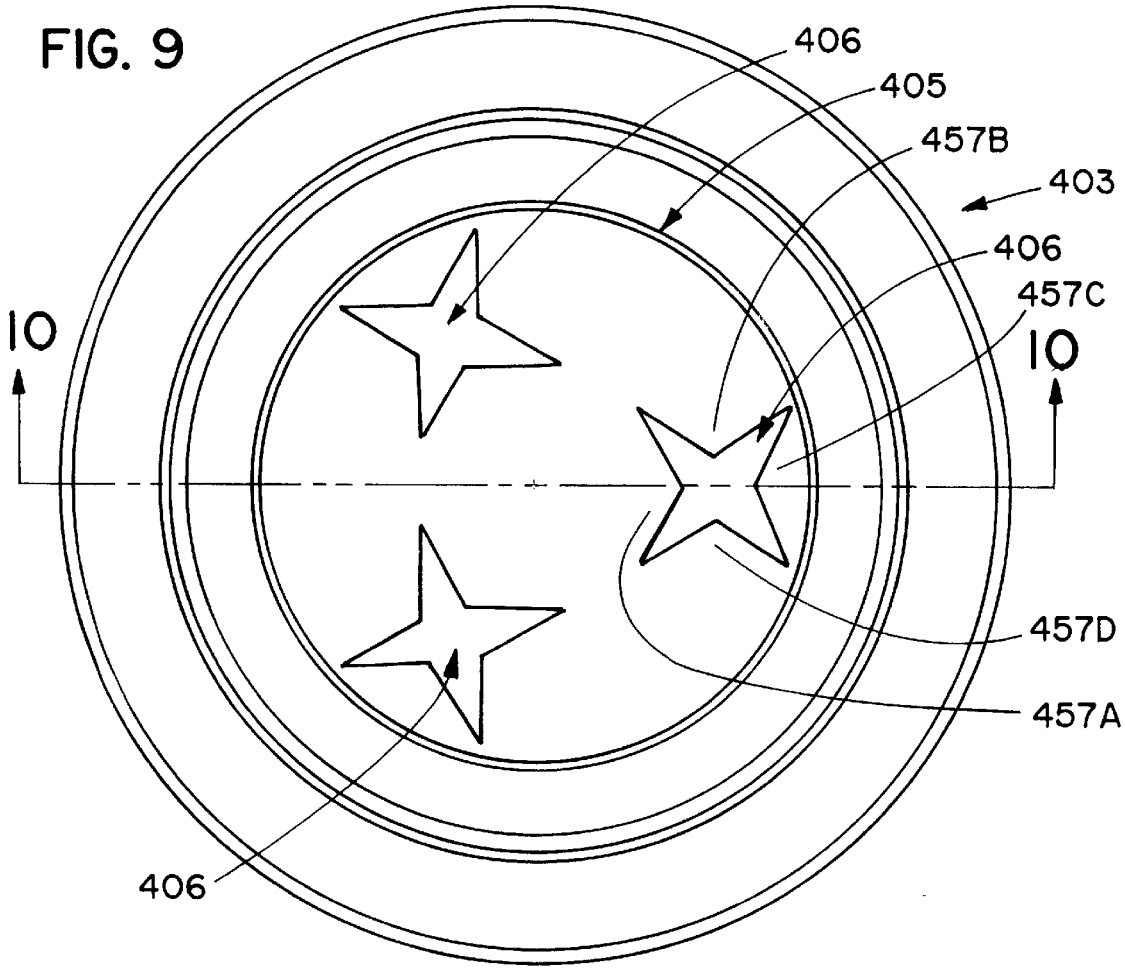
FIG. 9 is a view similar to FIG. 7, but FIG. 9 shows the final, full open condition of the valve.
Figure 10:
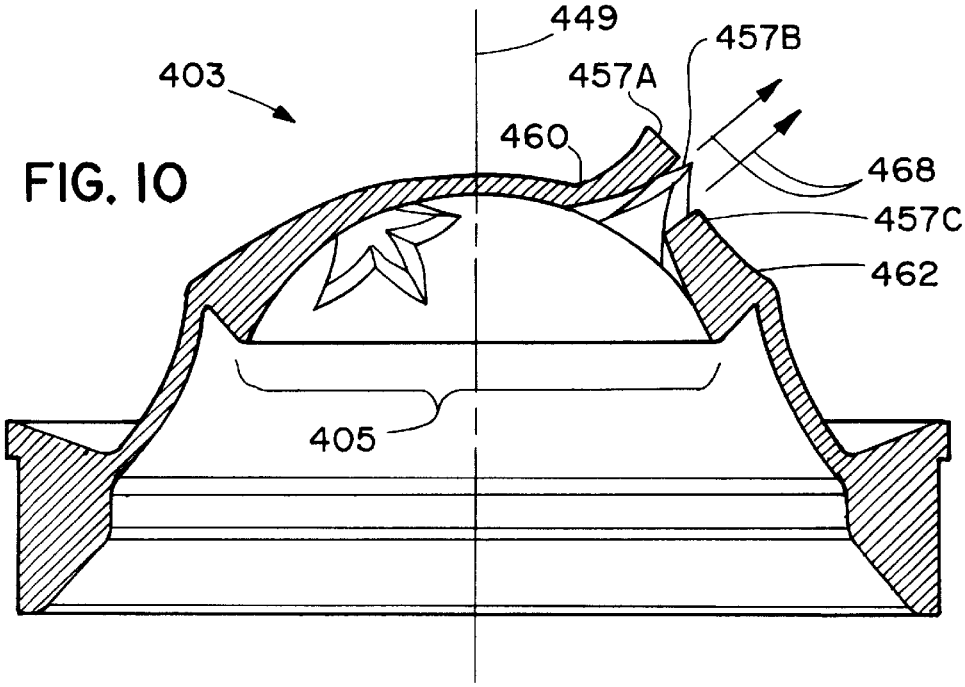
FIG. 10 is a cross-sectional view taken generally along the plane 10—10 in FIG. 9.

With reference to FIG. 8, it is presently believed that the annular shoulder 10 around the valve head 5 functions to, among other things, prevent valve head 5 from collapsing under the stress created by the torque transmitted from connector sleeve 7. It is believed that this prevents valve head 5 from collapsing and locking as sleeve 7 rolls from the inwardly extending configuration (FIG. 13) to the outwardly extending configuration (FIG. 15).

It is believed that the resiliency of connector sleeve 7 serves to resist the dilating action of valve head 5, and thereby compresses valve head 5 to help achieve a snap open and snap close motion. The resiliency of connector sleeve 7 can be varied somewhat, such as by making connector sleeve 7 thicker or thinner. This can result in a greater or lesser degree of snap action built into the valve for a specific application. Similarly, the size and resilient strength of shoulder 10 (adjacent the exterior peripheral portion of valve head 5 as illustrated in FIG. 3) can be adjusted to increase or decrease somewhat the desired snap action.

Because the combined compression and torque forces acting on head 5 of valve 3 by connector sleeve 7 open the flaps 57 to a generally predetermined maximum open configuration, the rate of flow of the product from container 2 through the valve discharge orifices 6 remains substantially constant during the majority of the time period when the product is flowing out of container 2 for a given constant pressure differential across the valve.

In some applications, container 2 will be designed with relatively stiff sidewalls which resume their original shape after being squeezed. In such embodiments, the suck back of air into container 2 after dispensing fluid product therefrom is typically desired to prevent collapsing the container 2, and thereby facilitate continued ease of dispensing until container 2 is completely empty. When valve 3 is in the fully closed and fully retracted position (FIG. 11), the concave configuration of valve head 5 permits orifices 6 to readily open inwardly so that ambient air can flow into container 2.

Figure 7:
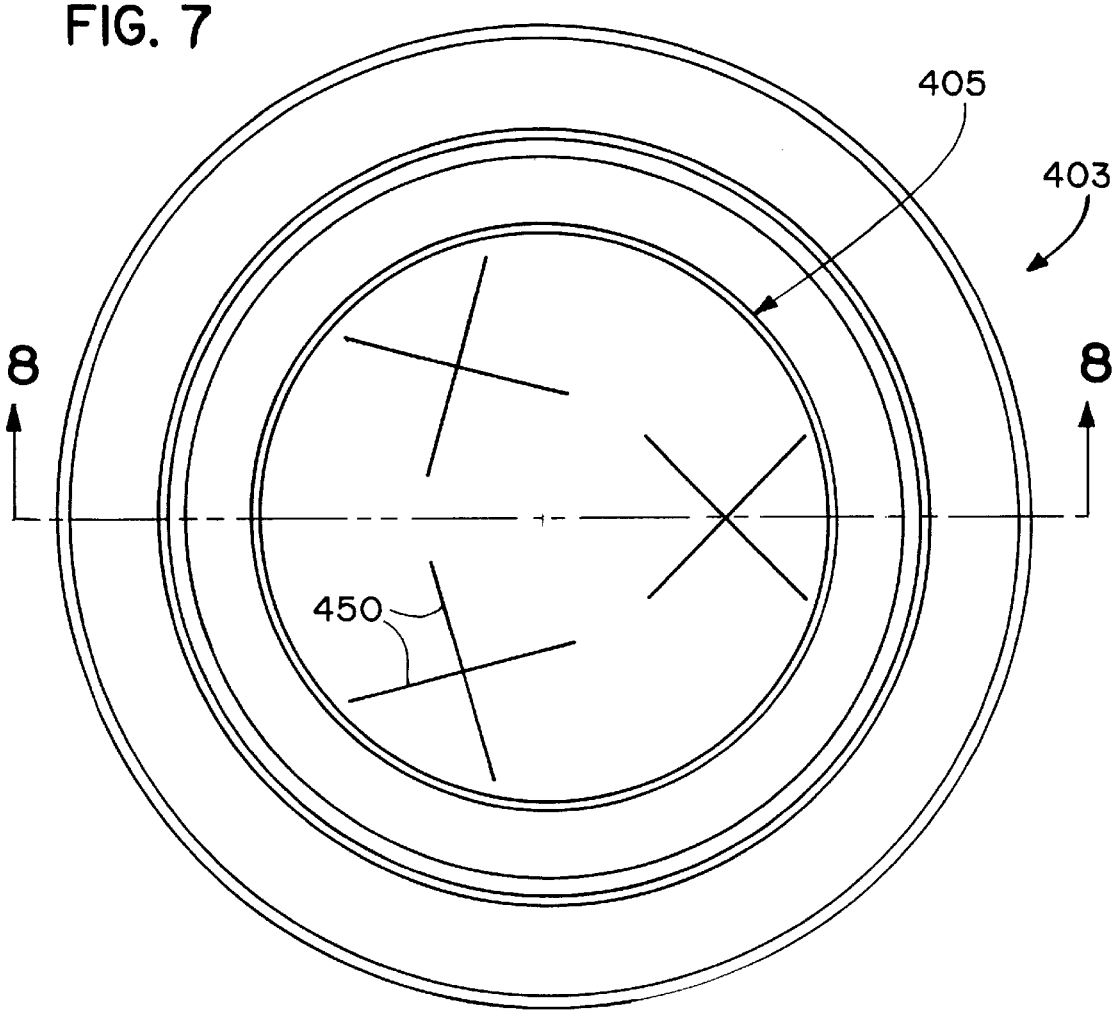
FIG. 7 is a view similar to FIG. 6, but FIG. 7 shows the valve in a pressurized condition causing movement of the valve head portion to an extended position prior to the valve orifices opening.

When valve 3 opens, the flow rate through the discharge orifices 6 can remain substantially constant, even if container 2 is subjected to some varying internal pressures. As the valve 3 extends to open and after valve head portion 5 passes through the unstable state or condition, the direction of opening, valve 3 quickly and positively assumes the fully open condition shown in FIG. 14. The marginal peripheral shoulder 10 is believed to rotate or pivot inwardly somewhat under the pressure of fluid product 18. It is believed that resilient torque applied to shoulder 10 by connected sleeve 5 continues to resiliently urge valve 3 back toward its original molded shape (FIG. 7). It is believed that connected sleeve 7 remains tensed both axially and circumferentially under outwardly directed forces generated by the pressures within container 2, as well as by the dynamic flow of fluid product through orifices 6. The geometry of the illustrated valve 3, particularly in the shape of valve head 5 and connector 7, serve to force valve 3 into the configuration shown in FIG. 15 whenever orifices 6 are snapped open.

When pressure within the interior of container 2 is reduced, or the ambient pressure on the valve exterior is increased, the discharge orifices 6 will still remain open in substantially the fully open position shown in FIG. 15 until the differential pressure across the valve pressure drops to a predetermined maximum closure pressure differential, at which point, the forces developed in connector sleeve 7 through elastic deformation from its original molded shape (FIG. 13), pull valve head 5 inwardly, back through the unstable state, and into, or at least toward, the concave orientation shown in FIG. 13, thereby positively and securely closing discharge orifices 6 with a snapping action, similar to that action by which discharge orifices 6 opened.

The snap closing motion of valve head 5 serves to close orifices 6 very quickly and very completely, so as to sharply cut off the stream of fluid product being dispensed from package 1 without any drops or dribbles, even when very viscous and/or dense products are being dispensed. If the differential pressure across valve 3 is sufficiently low, valve 3 will continue to move to the fully retracted, closed initial position illustrated in FIGS. 11 and 13.

It is contemplated by the present invention that a valve 3 may be designed to have a relatively high predetermined closing pressure, such as in the nature of 17–18 inches of water, so that orifices 6 will snap securely closed even if container 2 does not provide any suck back, or negative pressure. Furthermore, the connector sleeve 7 may be constructed to provide sufficient resiliency to automatically shift valve head 5 back to the fully retracted position (FIG. 11) without any suck back or negative pressure from container 2. Hence, valves 3 can be readily adapted for use in conjunction with containers which include collapsing bags, tubes, or the like. Also, the valve 3 is particularly suitable for bottom dispensing packages where valve 3 normally supports a column of liquid product.

In some applications, it may be desirable to provide valve 3 with a configuration of slits and thicknesses which cause the flaps 57 to remain open, even after the pressure differential drops to zero. The user could then dispense a large quantity of fluent product without continually squeezing the container 2.

In the preferred form of the valve, the reciprocating motion of valve head 5 on rolling connector sleeve 7 provides dispensing closure 1 with several important advantages. For example, connector sleeve 7 is preferably configured with sufficient flexibility so that abnormal pressure increases developed within the interior of container 2, such as those caused by thermal expansion, or the like, are offset by the axial shifting motion of valve head 5 with respect to connector sleeve 7, so as to alleviate excess pressure on discharge orifices 6. In this manner, if closure 1 were used in conjunction with a container of some liquid product and the ambient temperature rises, then the internal container pressure will increase, but the increased pressure, instead of acting directly at discharge orifices 6 in a manner which might cause them inadvertently open, causes valve head 5 to shift axially outwardly to relieve at least some of the increased pressure, and thereby minimize the possibility of any inadvertent leakage of the fluid product from dispensing closure 1.

Another example of the benefits achieved by the rolling diaphragm action of connector sleeve 7 and the axial reciprocating motion of valve head 5 is that connector sleeve 7 is preferably configured with sufficient flexibility so that any misalignment and/or distortion of the valve flange 4, such as that experienced when attaching the valve to closure 1 or container 2, is not transmitted to valve head 5, thereby permitting unhindered operation of discharge orifices 6. Due to the inherently sticky nature of liquid silicone rubber, the attachment of a molded silicone rubber valve 3 to container 2 or closure 1 can be quite difficult, and often results in some type of unequal compression and/or distortion of the marginal flange 4 of valve 3. Without the rolling diaphragm action of connector sleeve 7, such distortion can be communicated directly to valve head 5, and this in turn can distort discharge orifices 6, and alter important design characteristics such as its predetermined opening pressure, flow rate, etc. The rolling diaphragm connector sleeve 7 associated with the present valve 3 tends to insulate or isolate valve head 5 from marginal flange 4 such that valve head 5 can float freely, and thereby avoid such problems.

Yet another example of the benefits achieved by this aspect of the present invention is that connector sleeve 7 is preferably configured with sufficient flexibility so that vibrations, shock impact forces, and the like applied to container 2 are absorbed and/or dampened by shifting valve head 5 on rolling connector sleeve 7, so as to avoid inadvertent opening of the discharge orifices 6. If the container 2 with dispensing closure 1 is dropped onto the floor, slammed forcefully against a work surface, or otherwise jarred or shook, the shock forces arising from the acceleration and/or deceleration of the product within container 2 would be communicated directly with the discharge orifices 6, and tend to cause them to open inadvertently. However, the rolling connector sleeve 7 action of valve 3 serves as a cushion or shock absorber for such shock impact forces, and thereby greatly minimizes the likelihood of inadvertent discharge of fluid product from dispensing closure 1. In a similar manner, when dispensing closure 1 is used for non-homogenous fluids, or the like, which are typically shook prior to use, connector sleeve 7 assists in absorbing these vibrations, and thereby helps minimize the possibility of leakage.

Yet another example of the benefits achieved by this aspect of the present invention is that connector sleeve 7 can be preferably configured with sufficient flexibility so that only very moderate pressures, substantially lower than the predetermined opening pressure of valve 3, are required to shift valve head 5 from the fully retracted position (FIG. 13) to the fully extended position (FIG. 14), thereby improving the dispensing "feel" of closure 1. When the user grasps container 2, even a very light squeeze on sidewalls will rollingly extend a sufficiently flexible connector sleeve 7 and valve head 5 to the fully extended, but still closed configuration, at which point valve head 5 halts momentarily, and further movement of the fluid product is resisted until additional forces are exerted on container 2 which result in an internal pressure within container 2 greater than the predetermined opening pressure of valve 3. This motion of connector sleeve 7 and valve head 5 is sensed by the user through touch or feel, typically in the form of a vibration or ripple experienced in container sidewalls when valve head 5 reaches the fully extended position. This ripple motion signals the user that valve head 5 is fully extended, and that further pressure will cause valve 3 to snap open and dispense fluid products. When valve 3 snaps open, similar vibrations or ripples are communicated to the user through container sidewalls to assist in achieving accurate flow control.

In the illustrated example of dispensing closure 1, valve 3 is mounted within container 2 in a manner which causes valve head 5 to shift between (1) the fully retracted position shown in FIG. 11 wherein valve 3 is completely recessed, or disposed wholly, within the interior of closure 1 or container 2 for safely storing valve 3, and (2) the fully extended discharge position shown in FIG. 15 wherein valve head 5 and associated orifice 6 are disposed substantially outside of container 2 and closure 1 for neatly dispensing the product therethrough. By shifting valve head 5 between these two extreme positions, valve 3 can remain normally unexposed and secure within the closure 1 and/or container 2 when not in use, without sacrificing neatness when dispensing. Also, valve head 3 is preferably positioned in closure 1 and/or container 2 so that arcuate base portion 46 of connector sleeve 7 is disposed adjacent the end of closure spout 10 so that if the package is slammed down onto a surface, abutment between valve 3 and the surface will prevent valve 3 from shifting to the fully extended position, and thereby keep orifices 6 closed to prevent inadvertent leakage.

Without being limited to any specific dimensions, the invention includes one presently contemplated embodiment in the form of a valve molded from silicone rubber wherein the outer diameter of valve flange 4 is 0.642 inch, the inner diameter of valve flange 4 is 0.526 inch, the outer diameter of the edge 10D of shoulder 10 is 0.420 inch, the outer diameter D of the head portion 5 is about 0.338 inch, the thickness of the valve head portion 5 at the center is 0.023 inch, the thickness of the head portion 5 at the outer diameter D is 0.016 inch, the thickness of sleeve 7 is 0.012 inch, and the length of each slit 50 is 0.140 inch.

Figure 17:
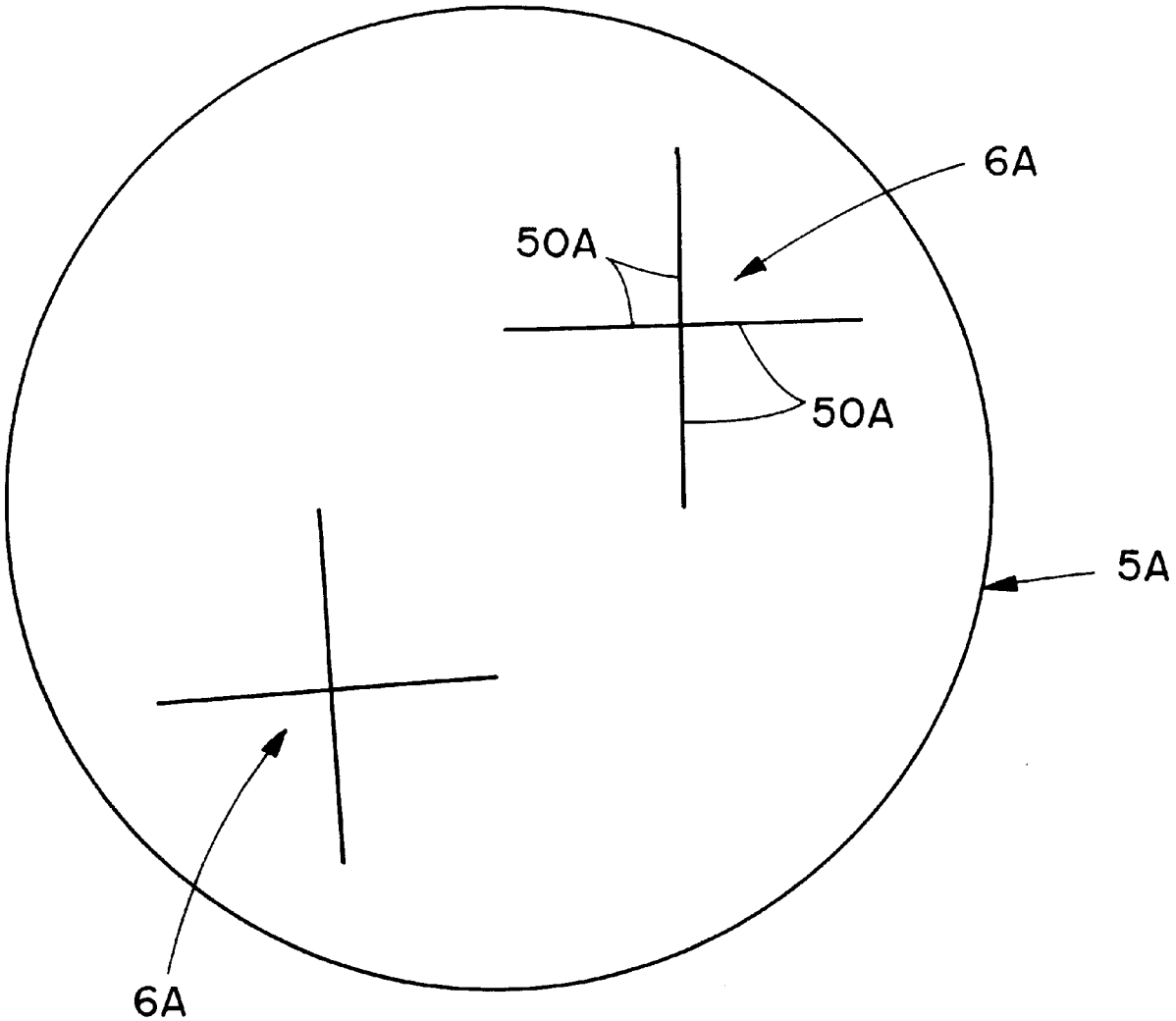
FIG. 17 is a simplified, plan view of a first alternate embodiment of the exterior side of the valve head portion.

FIG. 17 is a simplified, diagrammatic illustrated of a first alternate embodiment of valve head portion 5A which, except for the orifice slit configuration, may have a structure and configuration substantially identical with the structure and configuration, respectively, of valve head portion 5 described above in detail with reference to the embodiment illustrated in FIGS. 11–16. The first alternate embodiment of valve head portion 5A shown in FIG. 17 includes two orifices 6A which are each laterally offset from the center or longitudinal axis of valve head portion 5A and which are each defined by four slits 50A diverging radially from an origin at 90 degree angles to define two mutually perpendicular, intersecting, longer slits.

Figure 18:
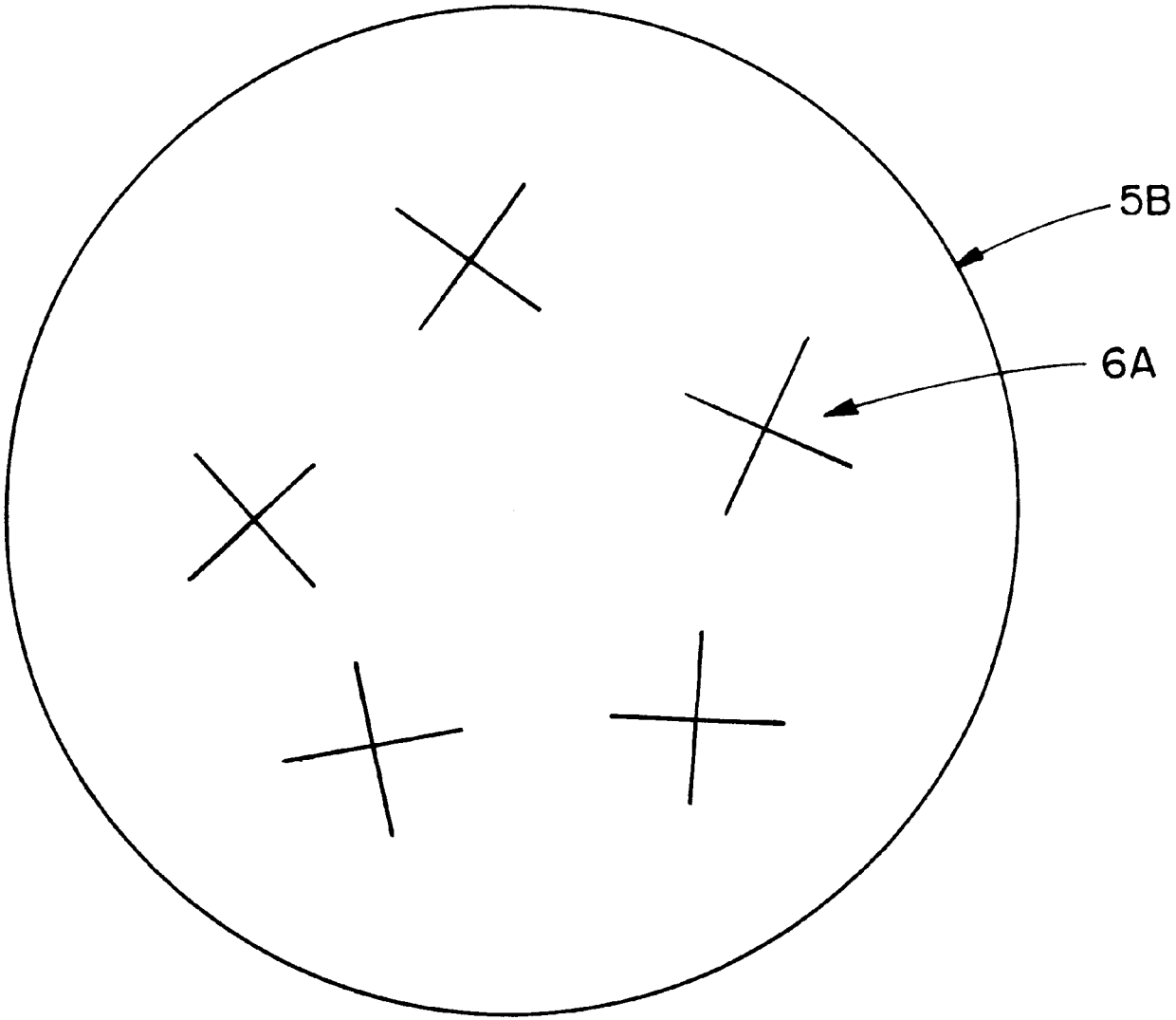
FIG. 18 is a simplified, plan view of a second alternate embodiment of the exterior side of the valve head portion.

FIG. 18 is similar to FIG. 17, but FIG. 18 illustrates a second alternate embodiment of valve head portion 5B which includes five orifices 6A, each laterally offset from the center or longitudinal axis of the head portion 5B. The orifices 6A are arranged equidistantly around a circular locus on the valve head portion 5B.

Figure 19:
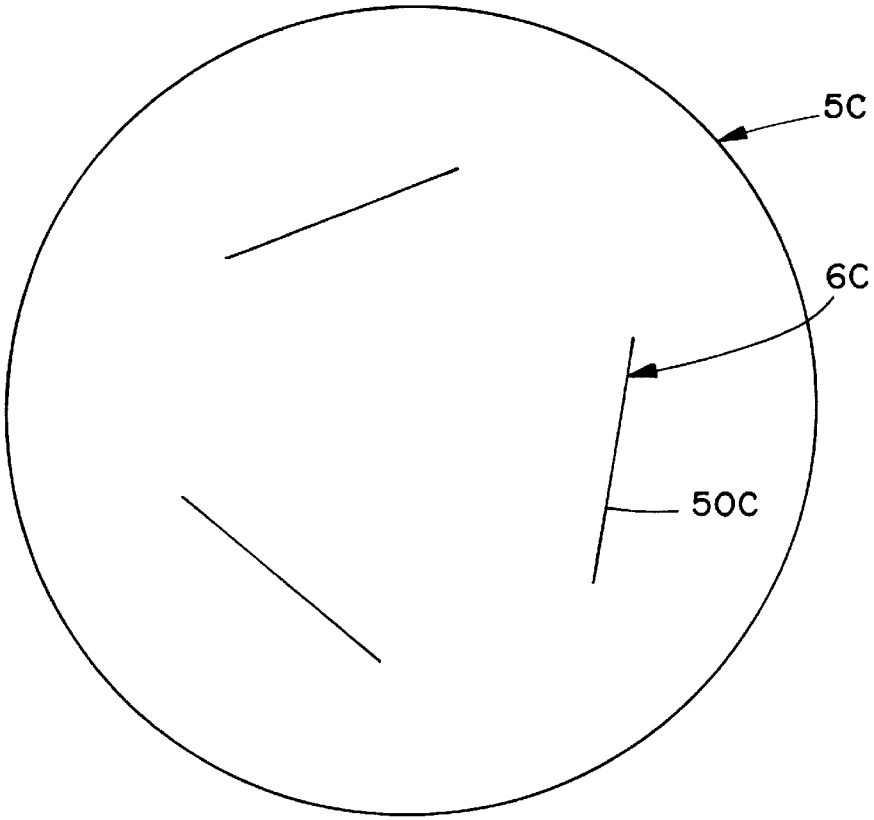
FIG. 19 is a simplified, plan view of a third alternate embodiment of the exterior side of the valve head portion.

FIG. 19 illustrates a third alternate embodiment of valve head portion 5C having three laterally offset orifices 6C, each defined by a single slit 50C. The slits 50C are oriented to lie along the sides of an imaginary triangle superimposed over the valve head portion 5C.

Figure 20:
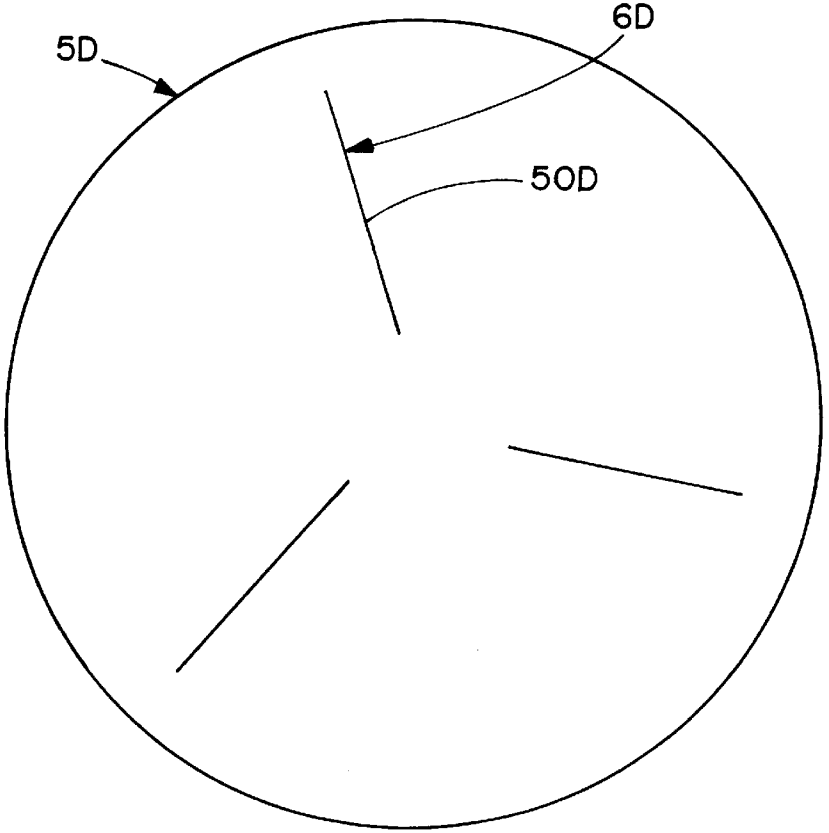
FIG. 20 is a simplified, plan view of a fourth alternate embodiment of the exterior side of the valve head portion.

FIG. 20 illustrates a fourth alternate embodiment of valve head portion 5D having three orifices 6D, each defined by a single slit 50D. The slits 50D are each disposed in an orientation on a radius of valve head portion 5D. Each slit 50D has an inner end closer to the longitudinal axis of the valve head portion 5D and an outer end further away from the longitudinal axis. Each slit 50D, if extended radially inwardly, would intersect the other slits at the longitudinal axis of the valve head portion 5D.

It will be appreciated that while various theories and explanations have been set forth herein with respect to how forces and stresses may effect the novel operation of the valve of the present invention, there is no intention to be bound by such theories and explanations. Further, it is intended that valve structures falling within the scope of the appended claims are not to be otherwise excluded from the scope of the claims merely because the operation of such valve structures may not be accounted for by the explanations and theories presented herein.

It will be readily apparent from the foregoing detailed description of the invention and from the illustrations thereof that numerous variations and modifications may be effected without departing from the true spirit and scope of the novel concepts or principles of this invention.

What is claimed is:

1. A dispensing valve for being sealingly disposed with respect to, and dispensing a product from, a discharge opening of a container, said valve comprising:

a marginal portion adapted to be sealingly engaged when said valve is sealingly disposed with respect to the container discharge opening; and a head portion that (1) is laterally inward of said marginal portion, (2) has an exterior side for interfacing with ambient environment, (3) has an interior side for interfacing with the product, (4) has a radially outside portion, (5) has a radially inside portion that is (a) surrounded by said radially outside portion, and (b) thicker than said radially outside portion, (6) has a plan shape oriented relative to a longitudinal axis through said valve, and (7) has at least one normally closed orifice that is (a) offset laterally from said longitudinal axis, and (b) defined by at least one slit that extends transversely through said head portion from said exterior side to said interior side whereby (a) flaps are defined by said slit, and (b) said orifice opens by outward displacement of said flaps in response to a predetermined pressure differential across the valve, wherein the periphery of said head portion is surrounded by, and merges with, a shoulder that is connected with said marginal portion and has a laterally outwardly flared crown shape defined, at least in part, by a tapered peripheral surface to prevent nesting with another, identical valve during handling.

2. The dispensing valve in accordance with claim 1 in which said valve is mounted in a dispensing closure that is separate from, but releasably attachable to, said container around said opening.

3. The dispensing valve in accordance with claim 2 in which said valve marginal portion includes an annular flange, and said annular flange has a dovetail cross-section, a first diverging surface, a second diverging surface, and a peripheral, cylindrical surface joining said first and second diverging surfaces; and said closure housing has a pair of frustoconical clamping surfaces for each engaging one of said first and second diverging surfaces of said valve flange.

4. The dispensing valve in accordance with claim 1, in which said head portion includes a plurality of orifices;

each of said orifice is defined by a plurality of slits extending laterally from a common origin;

each slit defines a linear locus through said head portion; and each said slit planar.

5. The dispensing valve in accordance with claim 4 in which said slits are of equal length.

6. The dispensing valve in accordance with claim 4 in which said slits are each planar and diverge radially from said origin to define equal size angles between each pair of adjacent slits.

7. The dispensing valve in accordance with claim 1, in which each orifice is defined by four of said slits diverging radially from an origin at 90° angles to define two mutually perpendicular, intersecting, longer slits.

8. A dispensing valve for being sealingly disposed with respect to, and dispensing a product from, a discharge opening of a container, said valve comprising:

a marginal portion adapted to be sealingly engaged when said valve is sealingly disposed with respect to the container discharge opening; and a head portion that (1) is laterally inward of said marginal portion, (2) has an exterior side for interfacing with ambient environment, (3) has an interior side for interfacing with the product, (4) has a radially outside portion, (5) has a radially inside portion that is (a)

surrounded by said radially outside portion, and (b) thicker than said radially outside portion, (6) has a plan shape oriented relative to a longitudinal axis through said valve, and (7) has at least one normally closed orifice that is (a) offset laterally from said longitudinal axis, and (b) defined by at least one slit that extends transversely through said head portion from said exterior side to said interior side whereby (a) flaps are defined by said slit, and (b) said orifice opens by outward displacement of said flaps in response to a predetermined pressure differential across the valve, wherein said head portion exterior side has an arcuate side elevational shape defined by a first radius, said head portion interior side has a planar central area and a laterally outer portion with an arcuate side elevational shape defined by a second radius which is less than said first radius such that said laterally outer portions of said exterior and interior sides converge toward the periphery of said head portion to provide a tapered construction with reduced thickness at the periphery.

9. A dispensing valve for being sealingly disposed with respect to, and dispensing a product from, a discharge opening of a container, said valve comprising:

a marginal portion adapted to be sealingly engaged when said valve is sealingly disposed with respect to the container discharge opening, and a head portion that (1) is laterally inward of said marginal portion, (2) has an exterior side for interfacing with ambient environment, (3) has an interior side for interfacing with the product, (4) has a radially outside portion, (5) has a radially inside portion that is (a) surrounded by said radially outside portion, and (b) thicker than said radially outside portion, (6) has a plan shape oriented relative to a longitudinal axis through said valve, and (7) has at least one normally closed orifice that is (a) offset laterally from said longitudinal axis, and (b) defined by at least one slit that extends transversely through said head portion from said exterior side to said interior side whereby (a) flaps are defined by said slit, and (b) said orifice opens by outward displacement of said flaps in response to a predetermined pressure differential across the valve, wherein said valve further includes a shoulder surrounding, and merging with, the periphery of said head portion, said shoulder being thicker than the periphery of said head portion; and a resilient, flexible, connector sleeve having (1) a first end portion thereof connected with said marginal portion, and (2) a second end portion thereof connected with said shoulder; said connector sleeve having an interior surface for interfacing with the product and having an exterior surface for interfacing with ambient environment, said first end portion of said connector sleeve having a J-shaped cross section which extends into said marginal portion to facilitate movement of said head portion when dispensing product from the container.

10. The dispensing valve in accordance with claim 9 in which in which the thickness of said sleeve is substantially constant between said end portions.

11. The dispensing valve in accordance with claim 9 in which said connector sleeve has (1) a resiliently flexible construction, and (2) a sidewall with a configuration which extends rollingly to shift said head portion outwardly.

12. A dispensing valve for being sealingly disposed with respect to, and dispensing a product from, a discharge opening of a container, said valve comprising:

a marginal portion adapted to be sealingly engaged when said valve is sealingly disposed with respect to the container discharge opening; and a flexible head portion that (1) is connected with said marginal portion, (2) is located laterally inward of said marginal portion, (3) has an exterior side for interfacing with ambient environment and that has a generally concave shape when viewed from outside the container, (4) has an interior side for interfacing with the product and that is defined by a surface that includes an annular marginal portion that has a generally arcuately shaped side elevational configuration, (5) has a radially outside portion, (6) has a radially inside portion surrounded by said radially outside portion wherein said radially inside portion is thicker than said radially outside portion, and (7) has at least one normally closed orifice that is (a) offset laterally from said longitudinal axis, and (b) defined by at least one slit that extends transversely through said head portion from said exterior side to said interior side whereby (a) flaps are defined by said slit, and (b) said orifice opens by outward displacement of said flaps in response to a predetermined pressure differential across the valve, wherein the periphery of said head portion is surrounded by, and merges with, a shoulder that is connected with said marginal portion and has a laterally outwardly flared crown shape defined, at least in part, by a tapered peripheral surface to prevent nesting with another, identical valve during handling.

13. The dispensing valve in accordance with claim 12, in which said valve is mounted in a dispensing closure that is separate from releasably attachable to, said container around said opening.

14. The dispensing valve in accordance with claim 13 in which said valve marginal portion includes an annular flange, and said annular flange has a dovetail cross-section, a first diverging surface, a second diverging surface, and a peripheral, cylindrical surface joining said first and second diverging surfaces; and said closure housing has a pair of frustoconical clamping surfaces for each engaging one of said first and second diverging surfaces of said valve flange.

15. The dispensing valve in accordance with claim 12, in which said head portion includes a plurality of orifices;

each of said orifice is defined by a plurality of slits extending laterally from a common origin;

each slit defines a linear locus through said head portion; and each said slit is planar.

16. The dispensing valve in accordance with claim 15 in which said slits are of equal length.

17. The dispensing valve in accordance with claim 15 in which said slits are each planar and diverge radially from said origin to define equal size angles between each pair of adjacent slits.

18. The dispensing valve in accordance with claim 12, in which each orifice is defined by four of said slits diverging radially from an origin at 90° angles to define two mutually perpendicular, intersecting, longer slits.

19. A dispensing valve for being sealingly disposed with respect to, and dispensing a product from, a discharge opening of a container, said valve comprising:

a marginal portion adapted to be sealingly engaged when said valve is sealingly disposed with respect to the container discharge opening; and a flexible head portion that (1) is connected with said marginal portion, (2) is located laterally inward of said marginal portion, (3) has an exterior side for interfacing with ambient environment and that has a generally concave shape when viewed from outside the container, (4) has an interior side for interfacing with the product and that is defined by a surface that includes an annular marginal portion that has a generally arcuately shaped side elevational configuration, (5) has a radially outside portion, (6) has a radially inside portion surrounded by said radially outside portion wherein said radially inside portion is thicker than said radially outside portion, and (7) has at least one normally closed orifice that is (a) offset laterally from said longitudinal axis, and (b) defined by at least one slit that extends transversely through said head portion from said exterior side to said interior side whereby (a) flaps are defined by said slit, and (b) said orifice opens by outward displacement of said flaps in response to a predetermined pressure differential across the valve, wherein said head portion exterior side has an arcuate side elevational shape defined by a first radius, said head portion interior side has a planar central area and a laterally outer portion with an arcuate side elevational shape defined by a second radius which is less than said first radius such that said laterally outer portions of said exterior and interior sides converge toward the periphery of said head portion to provide a tapered construction with reduced thickness at the periphery.

20. A dispensing valve for being sealingly disposed with respect to, and dispensing a product from, a discharge opening of a container, said valve comprising:

a marginal portion adapted to be sealingly engaged when said valve is sealingly disposed with respect to the container discharge opening; and a flexible head portion that (1) is connected with said marginal portion, (2) is located laterally inward of said marginal portion, (3) has an exterior side for interfacing with ambient environment and that has a generally concave shape when viewed from outside the container, (4) has an interior side for interfacing with the product and that is defined by a surface that includes an annular marginal portion that has a generally arcuately shaped side elevational configuration, (5) has a radially outside portion, (6) has a radially inside portion surrounded by said radially outside portion wherein said radially inside portion is thicker than said radially outside portion, and (7) has at least one normally closed orifice that is (a) offset laterally from said longitudinal axis, and (b) defined by at least one slit that extends transversely through said head portion from said exterior side to said interior side whereby (a) flaps are defined by said slit, and (b) said orifice opens by outward displacement of said flaps in response to a predetermined pressure differential across the valve, wherein said valve further includes a shoulder surrounding, and merging with, the periphery of said head portion, said shoulder being thicker than the periphery of said head portion; and a resilient, flexible, connector sleeve having (1) a first end portion thereof connected with said marginal portion, and (2) a second end portion thereof connected with said shoulder; said connector sleeve having an interior surface for interfacing with the product and having an exterior surface for interfacing with ambient environment, said first end portion of said connector sleeve having a J-shaped cross section which extends into said marginal portion to facilitate movement of said head portion when dispensing product from the container.

21. The dispensing valve in accordance with claim 20 in which in which the thickness of said sleeve is substantially constant between said end portions.

22. The dispensing valve in accordance with claim 20 in which said connector sleeve has (1) a resiliently flexible construction, and (2) a sidewall with a configuration which extends rollingly to shift said head portion outwardly.

* * * * *